US005689158A

United States Patent [19]

Chen

[11] Patent Number: 5,689,158

[45] Date of Patent: Nov. 18, 1997

[54] MULTI-MODE, HYBRID-TYPE CRT AND ELECTRON GUN THEREFOR WITH SELECTABLE DIFFERENT SIZED GRID APERTURES

[75] Inventor: Hsing-Yao Chen, Barrington, Ill.

[73] Assignee: Chunghwa Picture Tubes, Ltd., Taoyuan, Taiwan

[21] Appl. No.: 697,626

[22] Filed: Aug. 28, 1996

[51] Int. Cl.[6] ..... G09G 1/04; H01J 29/50; H01J 29/46

[52] U.S. Cl. ..... 315/382.1; 313/414; 313/409; 313/441; 313/447; 315/379

[58] Field of Search ..... 315/14, 15, 382.1, 315/379; 313/409, 441, 447, 414

[56] References Cited

U.S. PATENT DOCUMENTS

| | | | |
|---|---|---|---|
| 4,633,244 | 12/1986 | Holtey et al. | 340/736 |
| 5,036,258 | 7/1991 | Chen et al. | 315/382 |
| 5,287,038 | 2/1994 | Hagar et al. | 315/15 |
| 5,350,978 | 9/1994 | Chen | 315/368.15 |
| 5,389,855 | 2/1995 | Chen | 315/14 |
| 5,483,128 | 1/1996 | Chen | 315/382 |

FOREIGN PATENT DOCUMENTS

| | | | |
|---|---|---|---|
| 184242 | 10/1983 | Japan | H01J 29/50 |

OTHER PUBLICATIONS

Hughes et al., A Novel High-voltage Bipotential CRT Gun Design, IEEE Transactions on Consumer Electronics, vol. CE-25, No. 2, May 1979, pp. 185-192.

*Primary Examiner*—Gregory C. Issing
*Attorney, Agent, or Firm*—Emrich & Dithmar

[57] ABSTRACT

A color cathode ray tube (CRT) includes a multi-beam electron gun capable of operating in two or more modes for use as either a television receiver display or as a high resolution video monitor. The electron gun directs a plurality of electron beams onto the CRT's display screen, with the electron beams arranged in two or more groups. In one group of electron beams, the beam forming portion of the electron gun provides small diameter electron beams having reduced spot size on the CRT's display screen for high video image resolution when used as a monitor for graphics and/or character display. In another group of electron beams, the beam forming portion of the electron gun provides electron beams having a larger diameter and current for increased video image brightness when used as a television receiver. Each group of electron beams includes a plurality of horizontally aligned electron beams, with each beam providing one of the primary colors of red, green, or blue. The G2 control grid is divided into an upper G2 control grid for use in the television receiver mode of operation and a separate lower G2 control grid for use in the high resolution mode of operation, which grids may be independently positioned relative to the G1 screen grid and provided with selected, independent voltage values. By independently establishing the G1–G2 grid spacing and beam cutoff voltages for the two modes of operation, flexibility in electron gun performance and design is afforded.

22 Claims, 12 Drawing Sheets

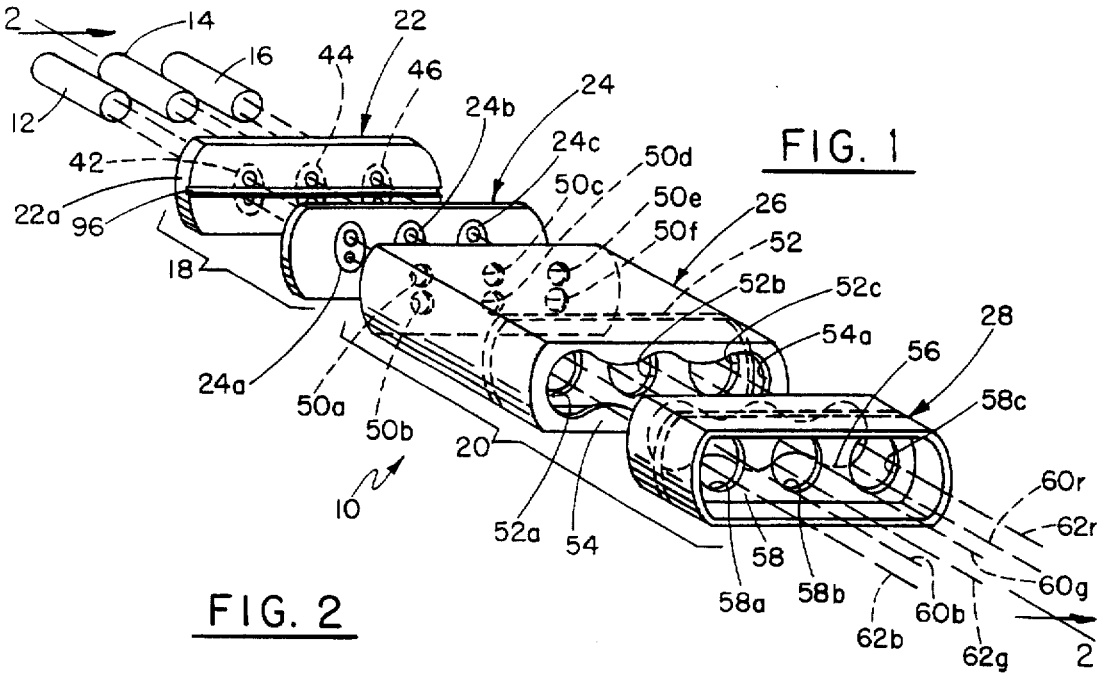
FIG. 1
FIG. 2
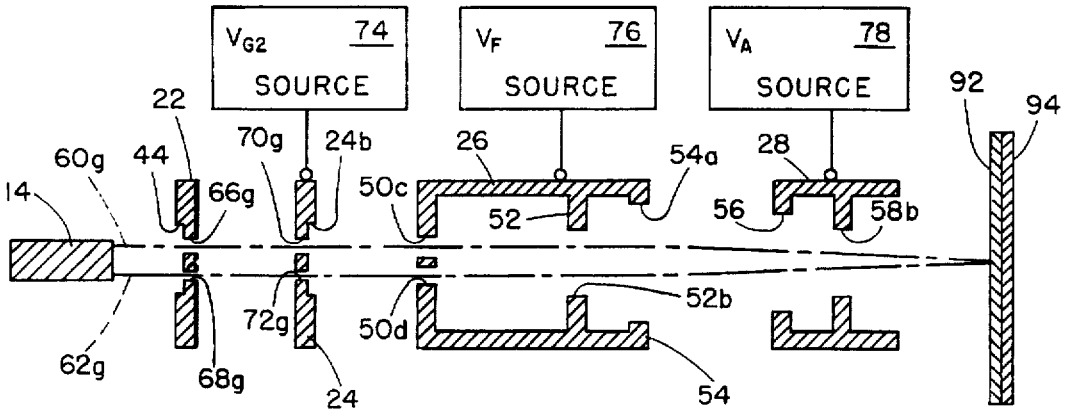
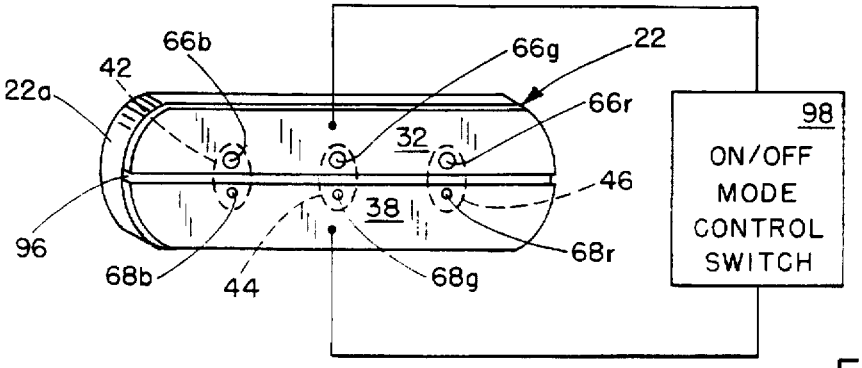
FIG. 3

Z
Y
X
94
92
120b
126
60b
62b
124
136
128
132
130
132c
132b
132a
134
58b
28
134b
138
56
54a
134a
118
52b
26
120
50c
50d
24
70g
72g
66g
68g
22
14
120a
122
22
66r
68r
46
66g
68g
44
66b
68b
42
96

60b
62b
24b
24
70g
72g

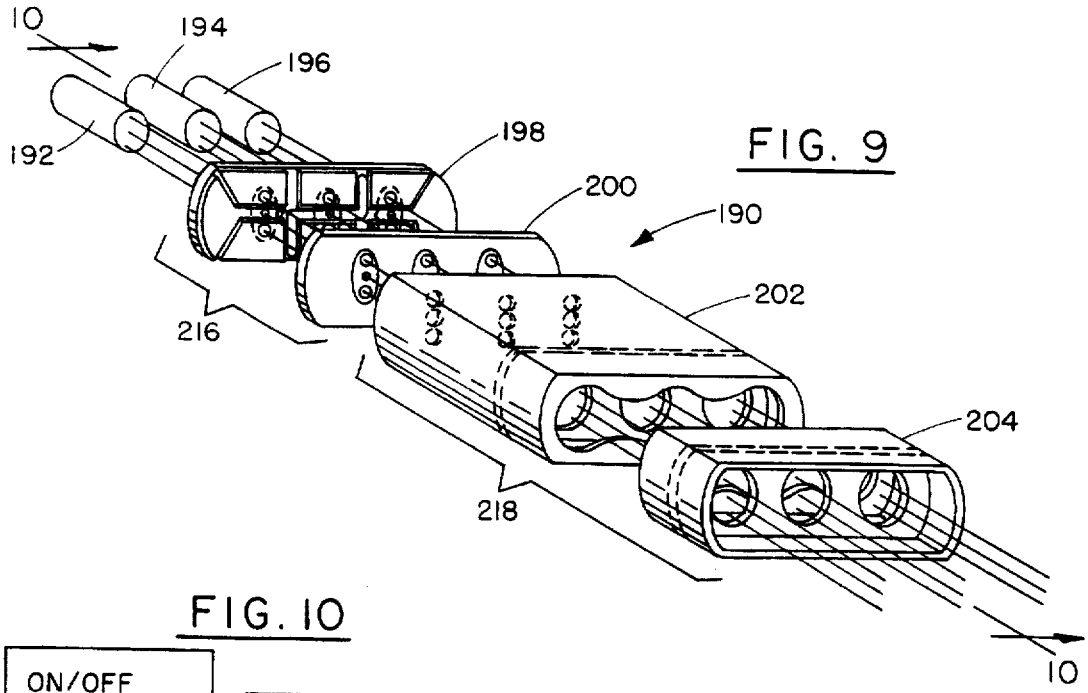
FIG. 9
FIG. 10
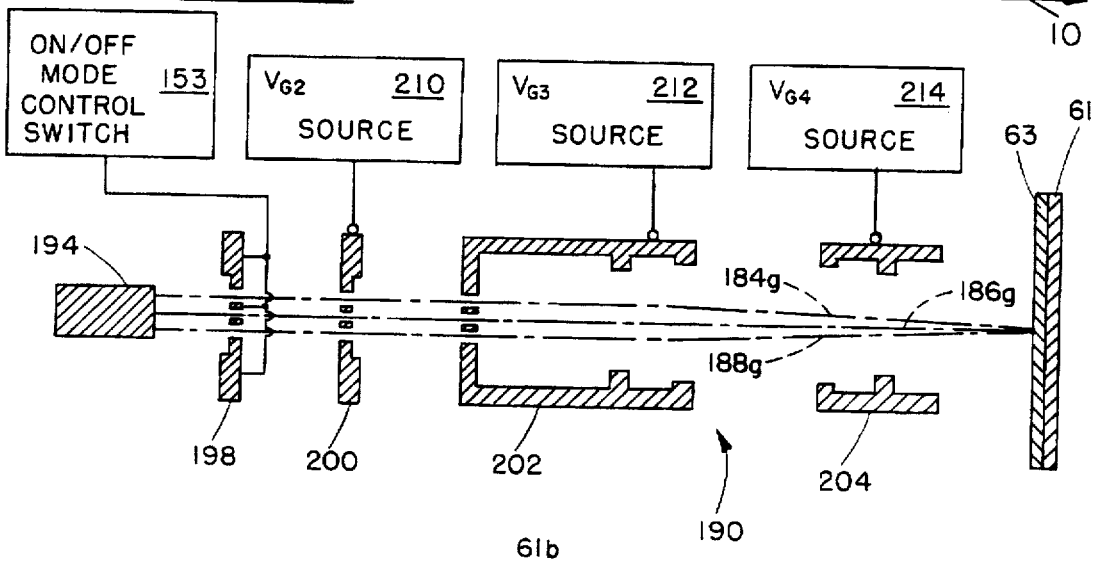
FIG. 11
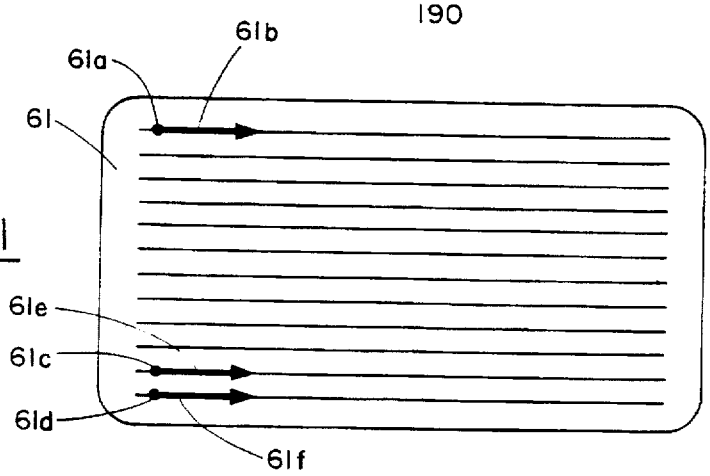

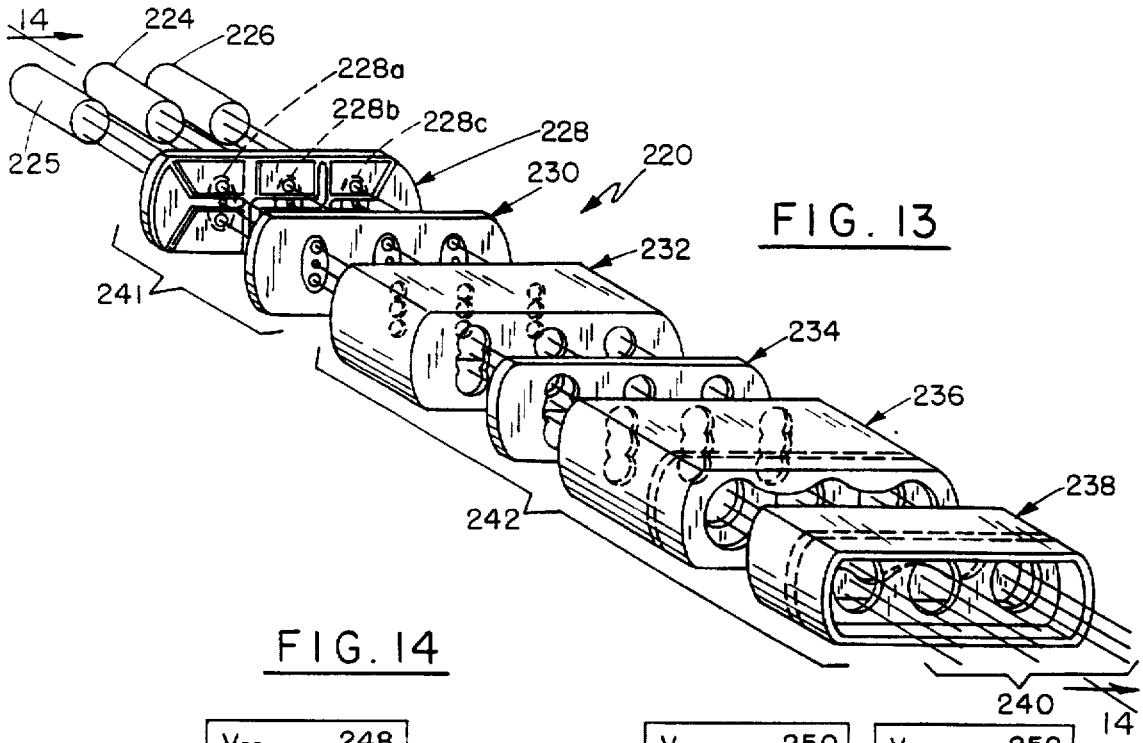
FIG. 13
FIG. 14
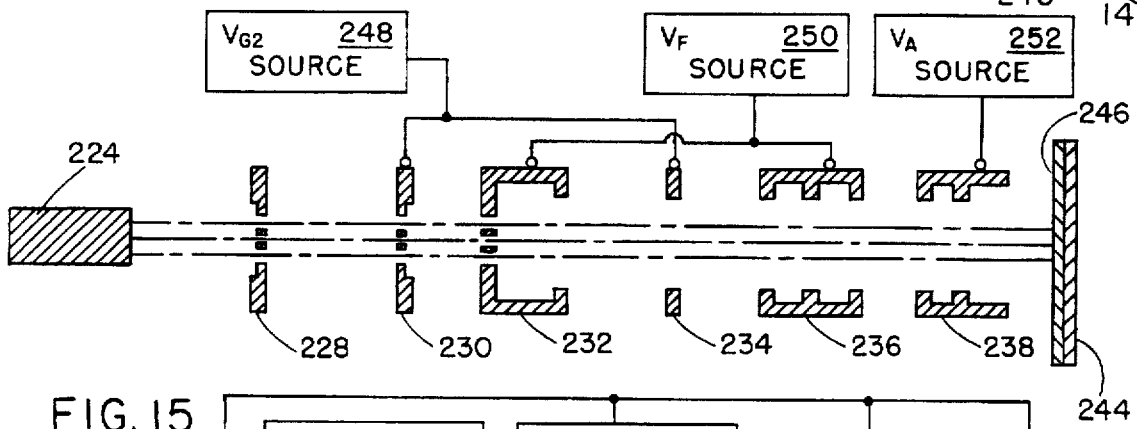
FIG. 15
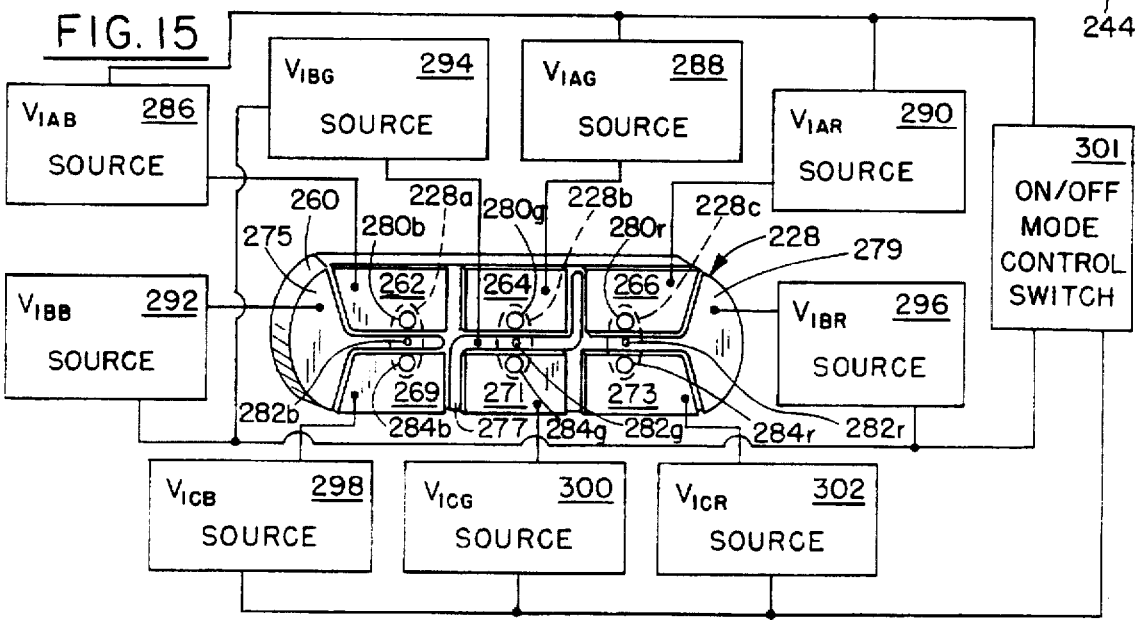

MULTI-MODE, HYBRID-TYPE CRT AND ELECTRON GUN THEREFOR WITH SELECTABLE DIFFERENT SIZED GRID APERTURES

FIELD OF THE INVENTION

This invention relates generally to video displays of the cathode my tube (CRT) type and is particularly directed to a multi-mode, hybrid-type of CRT, and electron gun therefor, capable of operating in a high video image resolution mode such as in a display monitor or in a high video image brightness mode as in a television receiver.

BACKGROUND OF THE INVENTION

CRTs are used in a wide variety of applications ranging from the conventional color television to high resolution computer monitors and very high resolution medical applications. In a color CRT, a plurality of electron beams are horizontally swept across the CRT's display screen in a roster-like manner, while in a monochrome CRT a single electron beam is displaced over the CRT display screen. Two of the more important operating criteria for both color and monochrome CRT displays are video image resolution and brightness. Video image brightness is particularly important in a television receiver CRT because the viewer is typically positioned a substantial distance from the CRT and because of the wide range of video image shades and, in the case of a color CRT, hues. Video image resolution is particularly important in a computer monitor because of the small size of the characters and graphics and close spacing between video image elements. Unfortunately, these two operating criteria are interrelated such that improvement in one performance parameter generally has an adverse effect on the other.

One approach to providing acceptable image brightness involving the use of higher beam currents employs a dispenser cathode which affords high electron emission densities. Higher beam currents require a higher cutoff voltage for the electron beam. One approach to increasing the beam cutoff voltage involves changing the spacing between the electron gun's G1 control grid and its G2 screen grid.

The present invention addresses the aforementioned problems encountered in the prior an by providing a multi-mode, hybrid-type CRT, and electron gun therefor, which can be used equally as well in a conventional television receiver in providing a high level of video image brightness or in a computer monitor for displaying high resolution graphics and alphanumeric character images. The inventive multi-mode, hybrid-type CRT and electron gun therefor directs a small diameter beam, or beams in the case of a color CRT, on the display screen for high video image resolution, or a larger diameter, higher current beam, or beams, for increased image brightness in a second mode of operation, where the two modes are selectable by a viewer. In addition, by independently establishing the G1–G2 grid spacing and beam cutoff voltages for the first and second modes of operation, additional flexibility in electron gun performance is provided.

OBJECTS AND SUMMARY OF THE INVENTION

Accordingly, it is an object of the present invention to provide a CRT and electron gun therefor operable in a first high video image resolution mode, such as in a video display monitor, or in a high brightness mode such as in a television receiver.

It is another object of the present invention to provide an electron gun for a CRT capable of directing one or more small diameter electron beams onto the CRT's display screen for high video image resolution or one or more larger diameter, higher current electron beams onto the CRT's display screen for increased video image brightness.

Yet another object of the present invention is to provide a multi-mode CRT for use as a television receiver or as a graphic/character monitor which employs one or more electron beams in each mode of operation, with the electron beam characteristics uniquely specified for each mode for improved CRT operation and user viewing.

A still further object of the present invention is to provide a CRT for displaying a video image when used either as a television receiver or monitor, wherein electron beam cross section and spot size are reduced when used as a monitor for improved video image resolution.

Another object of the present invention is to provide an electron gun having two selectable beam forming regions for two sets of electron beams, each having different characteristics for specific uses such as in a television receiver or high resolution display monitor.

A further object of the present invention is to provide a multi-mode electron gun having a beam forming region with separate G2 screen grids for each of a first high video image resolution mode and a second television receiver mode of operation.

A further object of the present invention is to provide a multi-mode, hybrid-type CRT and electron gun therefor with at least one set of separate electrodes for use in each of the different modes of operation which allows for increased electron gun performance flexibility for the various electron gun operating modes.

Yet another object of the present invention is to provide a multi-mode, hybrid-type electron gun which affords a high degree of performance and design flexibility by permitting the G1–G2 grid spacing as well as the electron beam cutoff voltage to be independently established for each mode of operation.

This invention contemplates an electron gun for use in a multi-mode cathode ray tube (CRT) including a display screen whereon a video image is formed by sweeping an electron beam over a plurality of vertically spaced, horizontal scan lines in a raster-like manner, the electron gun comprising: cathodes for providing energetic electrons; a beam forming region (BFR) including first and second spaced, charged grids disposed adjacent the cathodes and further including: a first beam forming arrangement for forming the energetic electrons into a first beam having a cross-section $A_1$ when the CRT is used as a television receiver; and a second beam forming arrangement for forming the energetic electrons into a second beam having a cross-section $A_2$ when the CRT is used as a high resolution video monitor, where $A_1>A_2$; the BFR further including a G1 control grid and a G2 screen grid each having first and second pairs of beam passing apertures, and wherein each of the pairs of beam passing apertures includes a first aperture having a diameter $D_1$ and a second aperture having a diameter $D_2$, and wherein the first apertures of the pairs of apertures form the first beam and the second apertures of the pairs of apertures form the second beam, with $D_1>D_2$, and wherein the G2 screen grid further includes a first electrode for defining a first aperture having a diameter $D_1$ for passing a first beam and a second electrode for defining a second aperture having a diameter $D_2$ for passing a second beam and wherein the first and second electrodes are separate and detached from one another; a switch coupled to the first and second beam forming means including the first and second electrodes of the G2 screen grid for allowing a user to select the first beam in either a television receiver mode of operation or the second beam in a high resolution video monitor mode of operation; and a lens disposed intermediate the BFR and the CRT's display screen for focusing either the first beam or the second beam on the display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a simplified isometric view shown partially in phantom of an electron gun for use in a multi-mode, hybrid-type color CRT in accordance with one embodiment of the present invention;

FIG. 2 is a generally vertical, longitudinal sectional view of the inventive electron gun shown in FIG. 1 taken along site line 2—2 therein;

FIG. 3 is an elevation view of the G1 control grid of the electron gun shown in FIG. 1 illustrating in simplified block diagram form video signal sources and a mode control switch coupled to the G1 control grid in accordance with one embodiment of the present invention;

FIG. 9 is a simplified isometric view shown partially in phantom of yet another embodiment of an electron gun for use in a multi-mode, hybrid-type CRT in accordance with the present invention;

FIG. 10 is a generally vertical, longitudinal sectional view of the electron gun shown in FIG. 9 taken along site line 10—10 therein;

FIG. 11 is a simplified elevation view of a CRT display screen illustrating the manner in which a plurality of vertically spaced, vertically aligned electron beams of the electron gun of FIG. 9 scan the display screen in forming either a high resolution or a high brightness color image thereon in accordance with another embodiment of the present invention;

FIG. 13 is a simplified isometric shown partially in phantom of an electron gun for a multi-mode, hybrid-type CRT in accordance with yet another embodiment of the present invention;

FIG. 14 is a generally vertical, longitudinal sectional view of the electron gun shown in FIG. 12 taken along site line 14—14 therein;

FIG. 15 is an elevation view of the G1 control grid of the electron gun shown in FIG. 12 also illustrating in simplified block diagram form video signal drivers and a mode control switch coupled to the G1 control grid;

DETAILED DESCRIPTION OF THE PREFERRED EMBODIMENTS

Figures 4, 5, 6:
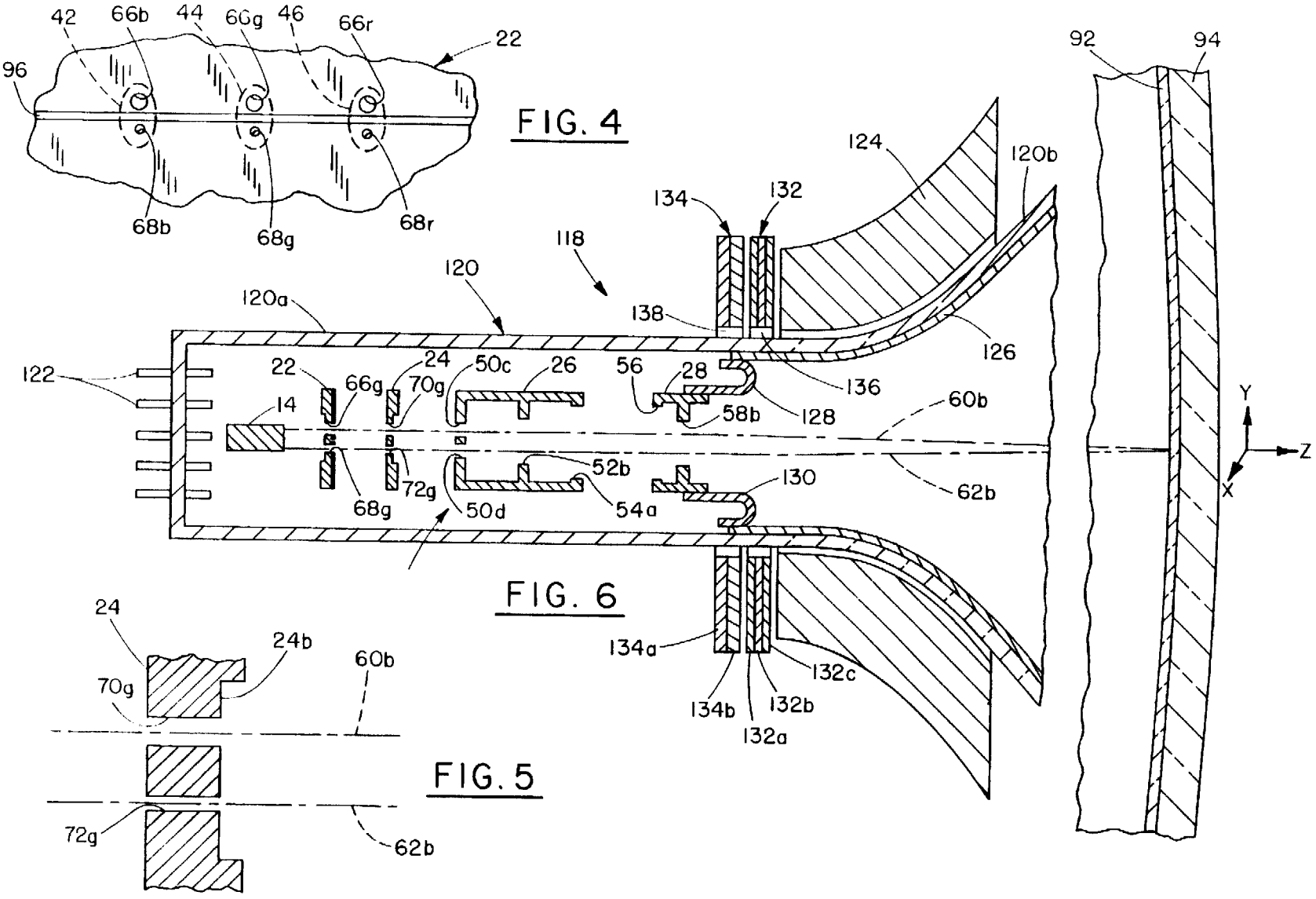
FIG. 4 is an enlarged view of a portion of the G1 control grid illustrated in FIG. 3.
FIG. 5 is a partial sectional view of a portion of the G2 screen grid in the electron gun of FIG. 1 illustrating the passing of two vertically spaced electron beams themthrough.
FIG. 6 is a partial vertical sectional view of a multi-mode, hybrid-type CRT and electron gun therefor as shown in FIG. 1 in accordance with the present invention.

Referring to FIG. 1, there is shown a simplified isometric view partially in phantom of an electron gun 10 for a color CRT in accordance with the principles of the present invention. FIG. 2 is a longitudinal vertical sectional view of the electron gun 10 shown in FIG. 1 taken along site line 2—2 therein.

Portions of the description of this invention which follows are related, but in no way dependent upon, the inventions disclosed and claimed in Applicant's co-pending applications for "Multi-beam Electron Gun for Monochrome CRT", Ser. No. 08/016,590, now U.S. Pat. No. 5,389,855, filed Feb. 10, 1993, and "Multi-beam Group Electron Gun for Color CRT" (allowed), Ser. No. 08/016,575, now U.S. Pat. No.

5,350,978, also filed Feb. 10, 1993. The disclosures of these two applications are hereby incorporated by reference in the present application.

Electron gun 10 is of the bi-potential type and includes a plurality of in-line cathodes 12, 14 and 16 for providing energetic electrons in the direction of a G1 control grid 22. Additional details of the G1 control grid 22 are shown in the elevation view of FIG. 3 and in the enlarged view of a portion of the G1 control grid of FIG. 4 and are described below. The G1 control grid 22 in combination with a G2 screen grid 24 provides a beam forming region (BFR) 18 in electron gun 10 for forming the energetic electrons into three pairs of vertically aligned electron beams 60*b*, 62*b*; 60*g*, 62*g*; and 60*r*, 62*r*. The center pair of electron beams are shown in dotted line form in the sectional view of FIG. 2 as upper electron beam 60*g* and lower electron beam 62*g*. Electron gun 10 further includes the combination of a G3 grid 26 and a G4 grid 28 which, in combination, form a high voltage focusing lens 20 for focusing the electron beams on the display screen 94 of a CRT. Disposed on the inner surface of display screen 94 is a phosphor layer, or coating, 92 for emitting light in response to the electron beams incident thereon in forming a video image on the display screen.

The G1 control grid 22 and the G2 screen grid 24 are both in the general form of flat plates having three pairs of vertically aligned apertures for passing the six electron beams. The G2 screen grid 24 includes three inline coined portions 24*a*, 24*b* and 24*c* each having a respective pair of vertically aligned beam passing apertures. The G1 control grid 22 is comprised of a non-conductive ceramic substrate 22*a* having first, second and third coined, or recessed, portions 42, 44 and 46 in facing relation to the three cathodes 12, 14 and 16. Disposed within the first coined portion 42 and extending through ceramic substrate 22*a* are a pair of vertically aligned apertures 66*b* and 68*b*. Similarly, respectively disposed within the second and third coined portions 44 and 46 and extending through the ceramic substrate 23*a* are second and third pairs of vertically aligned apertures 66*g*, 68*g* and 66*r*, 68*r*. Apertures 66*b* and 68*b* pass a pair of blue electron beams; apertures 66*g* and 68*g* pass green electron beams; and apertures 66*r* and 68*r* pass red electron beams. Thus, the trio of upper apertures 60*b*, 60*g* and 60*r* pass three electron beams for generating the primary colors for a low resolution display, while the lower trio of apertures 62*b*, 62*g* and 62*r* similarly pass three electron beams which generate the primary colon for a high resolution display. In this embodiment as well as in the embodiments described below, the vertical spacing between adjacent apertures is on the order of 50 mils while the horizontal spacing between adjacent apertures is on the order of 200 mils as in conventional inline electron guns. The three electron beams transmitting upper apertures 66*b*, 66*g* and 66*r* are converged and focused on a spot on the display screen, as are the electron beams transmitting the lower apertures 68*b*, 68*g* and 68*r* as shown in FIG. 2.

The G1 control grid 22 further includes upper and lower thin conductive portions 32 and 38 disposed on its surface facing the G2 screen grid 24. The conductive portions are formed on the G1 control grid's ceramic substrate 22*a* by affixing a thin conductive metallic layer to the surface of the ceramic substrate such as by brazing or cramping. A portion of the conductive layer is then removed in a conventional manner such as by chemical etching so as to form a continuous non-conductive insulating gap 96 separating the two conductive portions. Insulating gap 96 exposes the underlying ceramic substrate 22*a* and defines the two aforementioned conductive portions 32 and 38. Each of the conductive portions 32 and 38 encloses a trio of the G1 control grid's beam passing apertures 66*b*, 66*g*, 66*r*, 68*b*, 68*g* and 68*r*. Thus, upper conductive portion 32 encloses apertures 66*b*, 66*g* and 66*r*, while lower conductive portion 38 encloses apertures 68*b*, 68*g* and 68*r*. Video signal sources (not shown in the figures for simplicity) are coupled to the three cathodes 12, 14 and 16 for controlling the electrons emitted by the cathodes in accordance with a video image presented on the display screen. Such video signal sources and the manner in which they drive each of the cathodes are well known to those skilled in the relevant arts and may be conventional in design and operation.

Coupled to the upper conductive portion 32 is a user selectable ON/Off mode control switch 98, which is also connected to the lower conductive portion 38. The ON/OFF mode control switch 98 allows a user to control the biasing of the upper and lower conductive portions 32, 38 to block either the three upper electron beams to permit operation in the high resolution graphics and/or character display mode of operation or to block the three lower electron beams to permit operation in a television receiver mode. ON/OFF mode control switch 98 made be conventional in design and operation and typically would include a selectable switch and an appropriate voltage source (which also are not shown for simplicity).

As shown in the various figures, and particularly in FIG. 3, the upper three horizontally aligned apertures 66*b* (blue), 66*g* (green), and 66*r* (red) are larger in diameter than the three lower horizontally aligned apertures 68*b*, 68*g* and 68*r*. Similarly, as shown in FIG. 1 in the G2 screen grid 24 the upper three horizontally aligned apertures are larger in diameter than the three lower horizontally aligned apertures. In the disclosed embodiment, the upper trio of apertures in the G1 control grid 22 each have a diameter on the order of 0.5 mm–0.8 mm, while the upper trio of apertures in the G2 screen grid 24 each have a diameter on the order of 0.5 mm–1.0 mm. The lower trio of apertures in the G1 control grid 22 each preferably have a diameter on the order of 0.3 mm–0.5 mm, while the trio of lower apertures in the G2 screen grid 24 each have a diameter on the order of 0.3 mm–0.7 mm. The three cathodes 12, 14, and 16 in combination with the three larger horizontally aligned upper apertures in the G1 control grid 22 and in the G2 screen grid 24 are capable of emitting three electron beams each having a peak current on the order of 4 mA–5 mA for use when the CRT incorporating electron gun 10 is used as a television receiver. The three cathodes 12, 14 and 16, in combination with the three smaller horizontally aligned lower beam passing apertures in the G1 control grid 22 and in the G2 screen grid 24 are designed to direct three electron beams toward the CRT display screen, each having a peak current on the order of 400 μA–500 μA for use when the electron gun 10 is used in a high resolution video monitor mode of operation such as in a computer terminal. The three upper electron beams having a larger cross-section and peak current provide a video image of sufficient brightness for use in a conventional television receiver. The reduced cross-section of each of the three lower electron beams passing through the aligned trios of lower apertures in the G1 control and G2 screen grids 22, 24 with their reduced current provide a video image having high resolution for use in a CRT employed as a graphics and/or character display.

As shown in FIG. 2, the G2 screen grid 24 is coupled to a $V_{G2}$ voltage source 74 for proper biasing of the electron beams. Similarly, the G3 grid 26 is coupled to a focus voltage ($V_F$) source 76 for focusing the electron beams on the display screen 94, and the G4 grid 28 is coupled to an accelerating voltage ($V_A$) source 78 for accelerating the electrons toward the display screen.

As described above and as shown in greater detail in FIG. 5 which is a partial vertical sectional view of the G2 screen grid 24, the grid's coined, or recessed, portion 24*b* includes a pair of spaced, vertically aligned apertures 70*g* and 72*g* respectively passing upper and lower electron beams 60*b* and 62*b*. The G3 grid 26 includes three pairs of vertically spaced, horizontally aligned apertures 50*a*, 50*b*; 50*c*, 50*d*; and 50*e*, 50*f* in facing relation with the G2 screen grid 24 for passing respective pairs of electron beams. The G3 grid 26 further includes three inner, spaced oval apertures 52*a*, 52*b* and 52*c* respectively aligned with the aforementioned pairs of apertures for passing corresponding pairs of upper and lower electron beams. Finally, the G3 grid 26 includes a horizontally aligned, elongated, chain link-shaped common aperture 54*a* in facing relation with the G4 grid 28 passing the six electron beams. The G4 grid 28 similarly includes a horizontally aligned, chain link-shaped aperture 56 in facing relation with the G3 grid 26. The G4 grid 28 further includes three inner, spaced, oval apertures 58*a*, 58*b* and 58*c* for passing respective pairs of upper and lower electron beams.

Referring to FIG. 6, there is shown a partial longitudinal vertical sectional view of the electron gun 10 of FIGS. 1 and 2 in a color CRT 118 in accordance with the present invention. CRT 118 includes a glass envelope 120 having a cylindrical neck portion 120*a* and a funnel portion 120*b* of increasing diameter. CRT 118 further includes a plurality of stem pins 122 extending through the end of the neck portion 120*a* of the CRT's glass envelope 120 to provide various electrical signals to electron gun 10 as well as to other components within the CRT's glass envelope. Also disposed within the CRT's glass envelope 120 on the funnel portion 120*b* thereof is a conductive film 126 which is coupled to an anode voltage source which is not shown in the figure for simplicity. The G4 grid 28 is coupled to the internal conductive film 126 by means of a plurality of spaced, conductive positioning spacers 128 and 130 for charging the G4 grid to the anode voltage ($V_A$). A magnetic deflection yoke 124 is disposed about the CRT's funnel portion 120*b* for deflecting the electron beams over the display screen 94 in a raster-like manner. Omitted from FIG. 6, as well as from FIG. 2, is the color CRT's shadow mask which includes a large number of spaced apertures or slots and serves as a color selection electrode to ensure that each of the electron beams is incident upon selected color phosphor elements in the phosphor layer 92 on the inner surface of the display screen 94. The shadow mask is conventional in design and operation and for that reason is not discussed further herein.

Disposed about CRT 118 generally intermediate electron gun 10 and magnetic deflection yoke 124 are first and second multi-polar magnetic alignment arrangements 132 and 134. The first magnetic alignment arrangement 132 is comprised of a two-pole magnet (or dipole) 132*a*, a four-pole magnet (or quadrupole) 132*b* and a six-pole magnet 132*c*. The second magnetic alignment arrangement 134 includes a four-pole magnet 134*a* and a six-pole magnet 134*b*. The operation and configuration of the first and second multi-polar magnetic alignment arrangements 132, 134 in aligning the electron beams in a vertically spaced manner on the display screen 94 is conventional and thus well known to those skilled in the relevant art and is described in detail in the co-pending applications referenced above.

Figure 7:
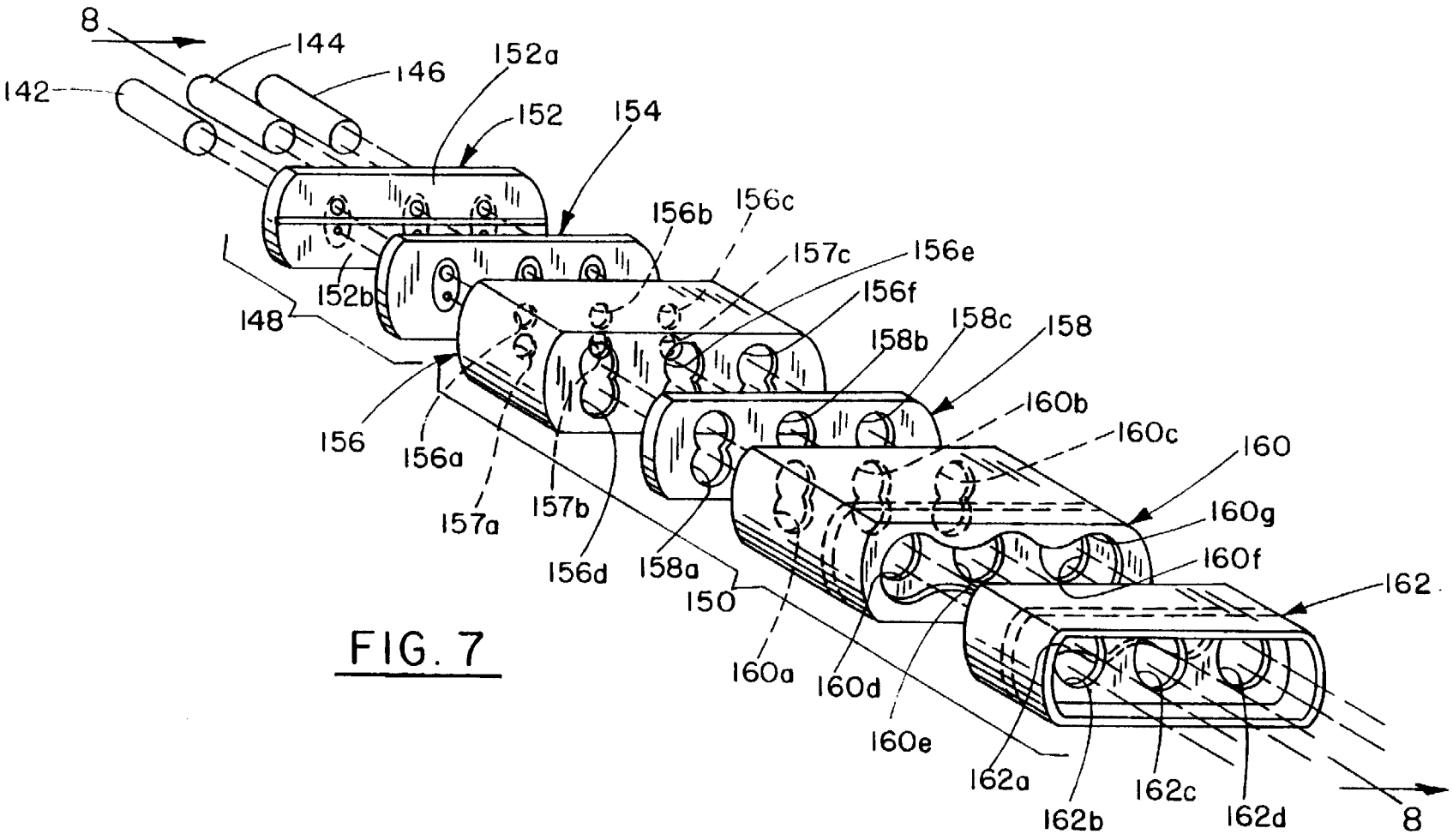
FIG. 7 is a simplified isometric view shown partially in phantom of another embodiment of a multi-beam electron gun for use in a multi-mode hybrid-type CRT in accordance with the principles of the present invention.
Figure 8:
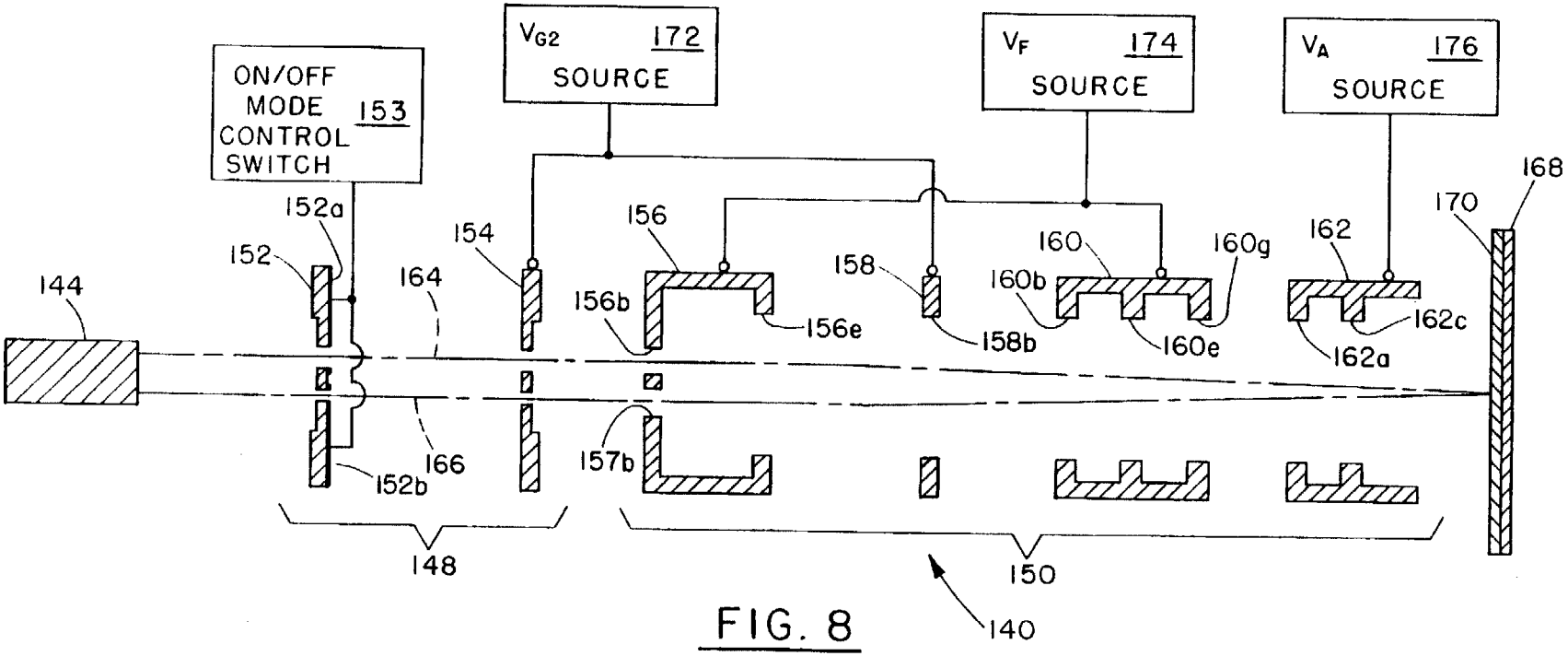
FIG. 8 is a generally vertical, longitudinal sectional view of the electron gun shown in FIG. 7 taken along site line 8—8 therein.

Referring to FIG. 7, there is shown another embodiment of a multi-beam group electron gun 140 for use in a color CRT in accordance with the present invention. FIG. 8 is a longitudinal vertical sectional view of the multi-beam group electron gun 140 shown in FIG. 7 taken along site line 8—8 therein. Electron gun 140 includes three inline cathodes 142, 144 and 146 for providing energetic electrons. Disposed adjacent to cathodes 142, 144 and 146 is a beam forming region (BFR) 148 which includes the combination of a G1 control grid 152 and a G2 screen grid 154. Electron gun 140 further includes a high voltage focusing lens 150 disposed intermediate BFR 148 and the CRT's display screen 168 as shown in the sectional view of FIG. 8. The high voltage focusing lens 150 includes a G3 grid 156, a G4 grid 158, a G5 grid 160 and a G6 grid 162. The G2 and G4 grids 154, 158 are coupled to a $V_{G2}$ voltage source 172, while the G3 and G5 grids 156, 160 are coupled to a focus voltage ($V_F$) source 174. The G6 grid 162 is coupled to an accelerating voltage ($V_A$) source 176. Electron gun 140 is thus of the quadrupole type.

As in the previously described embodiment, the G1 control grid 152 and the G2 screen grid 154 each include three pairs of vertically aligned apertures for forming six electron beams. Each of the electron beams passing through one of the pair of vertically aligned apertures provides one of the primary colors of red, green or blue on the CRT's display screen 168. A phosphor layer 170 is disposed on the inner surface of display screen 168. Three horizontally aligned electron beams are converged to a common spot on the CRT's display screen 168 and are displaced in unison along a common horizontal scan line with each sweep of the display screen.

The upper trio of horizontally aligned apertures in the G1 control and G2 screen grids 152 and 154 are larger in diameter than the lower trio of beam passing apertures in these two grids. The upper trio of electron beams thus have a larger cross section and peak current than the lower trio of electron beams. The relative size of these apertures in the G1 control and G2 screen grids 152 and 154 are preferably as set forth in the previously described embodiment. With an ON/OFF mode control switch 153 coupled to the upper and lower conductive portions 152*a* and 152*b* of the G1 control grid 152 as shown in FIG. 8, the upper trio of electron beams may be selected for use of the CRT in which electron gun 140 is employed as a television receiver, or the lower trio of electron beams may be selected for use of the CRT as a high resolution video monitor. Video information is provided to each of the three inline cathodes 142, 144 and 146 as in the previously described embodiment in a conventional manner.

The G3 grid 156 includes first, second and third horizontally aligned pairs of vertically spaced apertures 156*a*, 157*a*; 156*b*, 157*b*; and 156*c*, 157*c* in facing relation with the G2 screen grid 154 for passing the six (6) electron beams. The G3 grid 156 further includes a trio of figure eight-shaped apertures 156*d*, 156*e* and 156*f* in facing relation with the G4 grid 158. The enlarged upper and lower portions of each figure eight-shaped aperture is adapted to pass a respective electron beam, with apertures 156*a*, 157*a* and 156*d*; apertures 156*b*, 157*b* and 156*e*;, and apertures 156*c*, 157*c* and 156*f* in common alignment to pass either an upper or a lower one of the vertically aligned electron beams. The G4 grid 158 similarly includes three spaced figure eight-shaped apertures 158*a*, 158*b* and 158*c*, each adapted to pass either an upper or a lower one of the vertically aligned electron beams. The G5 grid 160 includes three inline figure eight-shaped apertures 160*a*, 160*b* and 160*c* in facing relation with the G4 grid 158. The 135 grid 160 further includes three inline oval apertures 160*d*, 160*e* and 160*f* which are respectively aligned with apertures 160*a*, 160*b* and 160*c* for passing either an upper or a lower one of the vertically aligned apertures. The G5 grid 160 further includes a horizontally aligned, elongated, chain link-shaped common aperture 160*g* in facing relation with the G6 grid 162 for passing all six electron beams. The G6 grid 162 similarly includes a horizontally aligned, chain link-shaped common aperture 162*a* as well as three inline oval apertures 162*b*, 162*c* and 162*d*. Common aperture 162*a* passes all six electron beams, while each of the oval shaped apertures 162*b*, 162*c* and 162*d* pass either an upper or a lower one of the vertically aligned electron beams.

Figure 12:
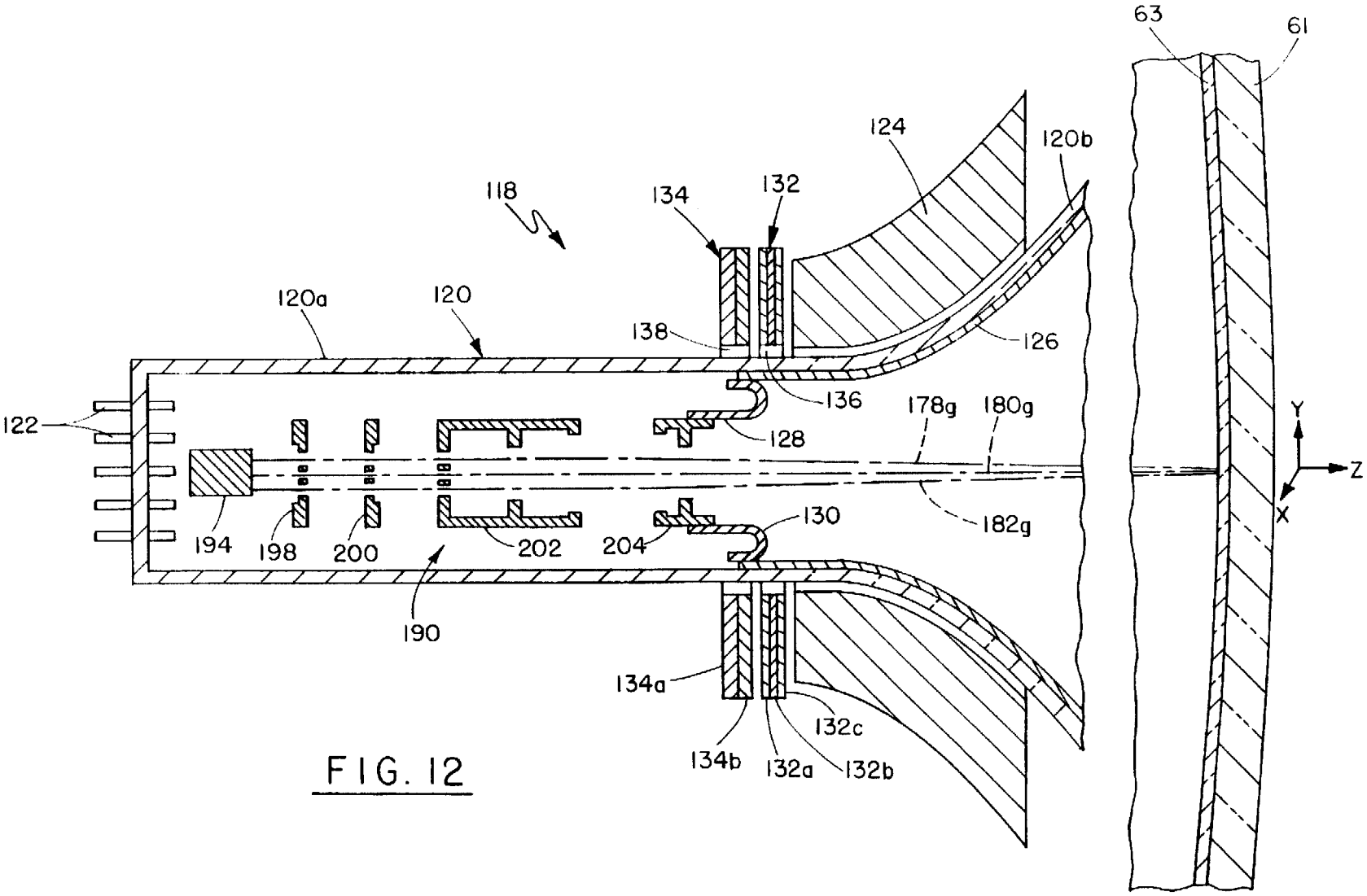
FIG. 12 is a partial vertical sectional view of a multi-mode, hybrid-type CRT incorporating the multi-beam electron gun shown in FIG. 9 in accordance with the present invention.

Referring to FIG. 9, there is shown partially in phantom an isometric view of another embodiment of a multi-beam group electron gun 190 for a color CRT in accordance with the principles of the present invention. FIG. 10 is a longitudinal vertical sectional view of the multi-beam group electron gun 190 shown in FIG. 9 taken along site line 10—10 therein, while FIG. 12 is a partial vertical sectional view of a CRT incorporating the electron gun of FIGS. 9 and 10. As in the case of the previously described electron gun 10 shown in FIG. 1, electron gun 190 shown in FIGS. 9 and 10 is of the bi-potential type. However, rather than having groups of only two vertically spaced electron beams for each of the primary colors, electron gun 190 directs three vertically aligned, spaced electron beams onto the CRT's display screen 61 for each of the primary colors of red, green and blue.

Electron gun 190 includes three inline cathodes 192, 194 and 196 for directing respective pluralities of energetic electrons toward a G1 control grid 198. Video signal information is provided to each of the three cathodes 192, 194 and 196 from respective video signal sources (not shown) in accordance with the color content of a video image as in the previously described embodiments. The G1 control grid 198 in combination with a G2 screen grid 200 comprises a BFR 216 for forming the energetic electrons into nine beams, where the center, vertically aligned electron beams are shown as elements 184*g*, 186*g* and 188*g* in FIG. 10. Electron gun 190 further includes a G3 grid 202 and a G4 grid 204, which combination comprises a high voltage focus lens 218 for accelerating the electrons toward and focusing the electron beams on the CRT's display screen 61. The G2 screen grid 200 is coupled to a $V_{G2}$ voltage source 210, while the G3 and G4 grids 202, 204 are respectively coupled to a $V_{G3}$ source 212 and a $V_{G4}$ source 214. The G1 control grid 198 is coupled to a plurality of video signal sources as described in detail below.

As in the previous embodiment, the G1 control grid 198 includes sets of three horizontally aligned apertures for directing three electron beams onto the CRT's faceplate for providing the primary colors of red, green and blue in a video image. However, unlike the previously described embodiment, the G1 control grid 198 in electron gun 190 includes nine (9) electron beam passing apertures in a 3×3 matrix. Each of the beam passing apertures is disposed within a respective conductive portion on the surface of the G1 control grid 198 in facing relation to the G2 screen grid 200. Each of the conductive portions on the surface of the G1 control grid 198 is coupled to a mode control switch 153 as shown in FIG. 10 as well as to a video signal source (not shown for simplicity) as previously described.

As shown in FIGS. 9 and 10, the upper and lower horizontally aligned trios of beam passing apertures within the G1 control and G2 stream grids 198, 200 are larger in diameter than the middle trio of apertures. The upper and lower trios of electron beams are therefore larger in cross-section and have a greater peak current than the three middle horizontally aligned electron beams. The mode control switch 153 coupled to the conductive portions on the surface of the G1 control grid 198 allow a viewer to select either the three upper electron beams and three lower electron beams or the three middle electron beams. The three intermediate electron beams are selected for providing a high resolution video image when the CRT is used as a graphic/character monitor, while the upper and lower sets of electron beams are selected when the CRT is used as a conventional television receiver.

As shown in FIG. 10, when the upper and lower sets of electron beams are employed as in a television receiver, the three upper and three lower electron beams are converged to a single point on the CRT's display screen 61 which includes an inner phosphor layer 63. In this mode of operation, an appropriate signal is provided to the three upper and three lower conductive portions of the G1 control grid 198 by the ON/OFF mode control switch 153 to permit transit of the three upper and the three lower electron beams through the G1 control grid. Also in this mode of operation, the ON/OFF mode control switch 153 provides an appropriate signal to the three intermediate conductive portions of the G1 control grid 198 to block the three intermediate electron beams. As shown in the simplified elevation view of the CRT's display screen 61 of FIG. 11 for the first (or top) scan line, either the three horizontally aligned middle electron beams are converged to a single spot 61*a* when in the high resolution video monitor mode, or the nine upper and lower sets of electron beams are converged to a single spot when in the television receiver mode. The electron beam spot 61*a* is traced along arrow 61*b* in a horizontal path across the display screen 61, which scanning is continuously repeated in a raster-like manner over the display screen. In another embodiment described in detail below, in the television receiver mode of operation the upper and lower trios of electron beams are converged on respective upper and lower spots 61*c* and 61*d* on display screen 61. These two electron beams spots 61*c* and 61*d* are shown on the bottom two horizontal scan lines of the display screen 61 for explanatory purposes. The two electron beam spots 61*c*, 61*d* are simultaneously deflected along arrows 61*e* and 61*f*, respectively, such that each group of three electron beams scans over the display screen in a raster-like manner. Following tracing of the electron beams of the bottom horizontal scan lines, the beams are deflected upward and to the left so as to re-initiate tracing of the upper most horizontal scan lines. The electron beams forming the upper and lower electron beam spots 61*c* and 61*d* contain different color information relating to different portions of the video image presented on the display screen 61. The simultaneous presentation of different video image information on two adjacent horizontal scan lines permits the beam scan frequency to be reduced while maintaining the same frame trace time for each complete scan of the video image on the display screen 61. With a reduction in the horizontal scan frequency, the electron beam dwell time on the display screen is correspondingly increased allowing for a reduction in individual beam electron density while maintaining a small beam spot size and high video image resolution and brightness because of a corresponding increase in beam dwell time.

Referring to FIG. 13, there is shown another embodiment of a multi-beam group electron gun 220 of the quadrupole type in accordance with the another embodiment of the present invention. A longitudinal sectional view of the multi-beam group electron gun 220 of FIG. 13 taken along site line 14—14 therein is shown in FIG. 14. Electron gun 220 includes three spaced, inline cathodes 222, 224 and 226 for directing energetic electrons toward a G1 control grid 228. The G1 control grid 228 in combination with a G2 screen grid 230 comprises a BFR 241 for forming the energetic electrons into nine electron beams 240 (shown in dotted-line form) comprised of three spaced groups of three vertically aligned electron beams. The G1 control and G2 screen grids 228, 230 thus each include nine apertures within respective pairs of apertures in the two grids aligned so as to pass the nine electron beams. Electron gun 220 further includes a high voltage focusing lens 242 comprised of a G3 grid 232, a G4 grid 234, a G5 grid 236, and a G6 grid 238 for accelerating the electrons toward and focusing the electron beams on a CRT display screen 244 having an inner phosphor coating 246. The G2 screen grid 230 and the G4 grid 234 are coupled to a $V_{G2}$ voltage source 248, while the G3 grid 232 and the G5 grid 236 are coupled to a focus voltage ($V_F$) source 250. The G6 grid 238 is coupled to an accelerating voltage ($V_A$) source 252.

Referring to FIG. 15, there is shown an elevation view of the G1 control grid 228 in accordance with this embodiment of the present invention. The surface of the G1 control grid 228 facing the three cathodes 222, 224 and 226 includes three spaced coined, or recessed portions 228*a*, 228*b* and 228*c* shown in dotted-line form. Disposed within the first coined portion 228*a* are three vertically aligned apertures 280*b*, 282*b* and 284*b* as shown in FIG. 14. Similarly, the center coined portion 228*b* includes three vertically aligned apertures 280*g*, 282*g* and 284*g*. Finally, the third coined portion 228*c* includes vertically aligned apertures 280*r*, 282*r* and 284*r*. The first three vertically aligned apertures pass electron beams which provide the color blue, while the second and third groups of vertically aligned apertures respectively pass electron beams which provide the colors green and red.

The G1 control grid 228 is comprised of a non-conductive ceramic substrate 260 having on its surface facing the G2 screen grid 230 a plurality of thin conductive elements each encompassing a respective one of the beam passing apertures. Each of these conductive elements is coupled to a respective video signal for modulating the electron beam passing through its associated aperture. Thus, the upper row of beam passing apertures 280*b*, 280*g* and 280*r* are respectively disposed in conductive portions 262, 264 and 266 on the surface of ceramic substrate 260. Similarly, each of the lower row of apertures 284*b*, 284*g* and 284*r* is disposed within a respective one of the conductive portions 269, 271 and 273. Finally, the middle row of beam passing apertures 282*b*, 282*g* and 282*r* are respectively disposed in conductive portions 275, 277 and 279. The conductive portions are formed by attaching a thin metallic layer to the surface of the ceramic substrate 260 such as by brazing or cramping. Portions of the thus attached metal layer are then removed by conventional means such as chemical etching so as to form the separated, discrete conductive portions shown in the figure. An insulating gap is thus formed between adjacent pairs of conductive portions so as to electrically isolate the conductive portions from one another. Each of the aforementioned conductive portions has essentially the same surface area so as to provide each conductive portion with essentially the same capacitance.

As shown in FIG. 15, each of the aforementioned conductive portions is coupled to and driven by a respective video signal source. Thus, the upper row of conductive portions 262, 264 and 266 are respectively coupled to $V_{1AB}$, $V_{1AG}$ and $V_{1AR}$ video signal sources 286, 288 and 290. Similarly, each of the conductive portions 269, 271 and 273 in the lower row is coupled to a respective one of the $V_{1CB}$, $V_{1CG}$ and $V_{1CR}$ video signal sources 298, 300 and 302. Finally, each of the intermediate, or center, conductive portions 275, 277 and 279 is coupled to a respective one of the video signal sources $V_{1BB}$, $V_{1BG}$ and $V_{1BR}$ video signal sources 292, 294 and 296. With each of the beam passing apertures disposed within and extending through a respective one of the conductive portions, variations in the video signals provided to each of the conductive portions allows an electron beam passing through each respective aperture to be modulated in accordance with the video image to be presented on the display screen. In this manner, the embodiment of the G1 control grid 228 shown in FIG. 18 permits nine electron beams to be modulated in accordance with nine separate video signals.

As shown in FIG. 14, each of the three trios of upper, center and lower electron beams is directed onto a different spot on the CRT's display screen 244. Thus, the upper trio of electron beams are converged onto an upper spot, the center electron beams are converged onto a center spot, and the lower trio of electron beams are directed onto a lower spot, with the three electron beam spots aligned vertically. In the television receiver mode of operation, an ON/OFF mode control switch 301 coupled to each of the aforementioned video signal sources as shown in FIG. 15 turns on the upper three and the lower three electron beams for directing these beams onto the aforementioned upper and lower spots. In this mode, the three middle electron beams having a smaller cross section are turned off. In a second, high resolution mode such as for a graphics/character monitor, the upper and lower trios of electron beams are turned off and the $V_{1BB}$ source 292, the $V_{1BG}$ source 294, and the $V_{1BR}$ source 296 are turned on for directing three horizontally aligned, small diameter electron beams onto the CRT's display screen while providing a video image with high resolution. In the first embodiment, the upper and lower spots are in vertical alignment and simultaneously scan the display screen 244 in a Faster-like manner as previously described. The simultaneous presentation of different image information on two adjacent horizontal scan lines permits the beam scan frequency to be reduced while maintaining the same frame trace time for each complete scan of the video image on the display screen 244. With a reduction in the horizontal scan frequency, electron beam dwell time on the display screen is correspondingly increased allowing for a reduction in individual beam electron density while maintaining small beam spot size and high video image resolution and brightness. As described in above referenced application Ser. No. 08/016,575, now U.S. Pat No. 5,350,978, the three video signal sources $V_{1AB}$, $V_{1AG}$ and $V_{1AR}$ coupled to the upper three conductive portions of the G1 control grid 222 and the three video signal sources $V_{1CB}$, $V_{1CG}$ and $V_{1CR}$ 298, 300 and 302 coupled to the three lower conductive portions include an information processing delay arrangement or similar scheme for delaying video information contained in the upper electron beams relative to the lower electron beams as they simultaneously scan the CRT's display screen.

Figure 16:
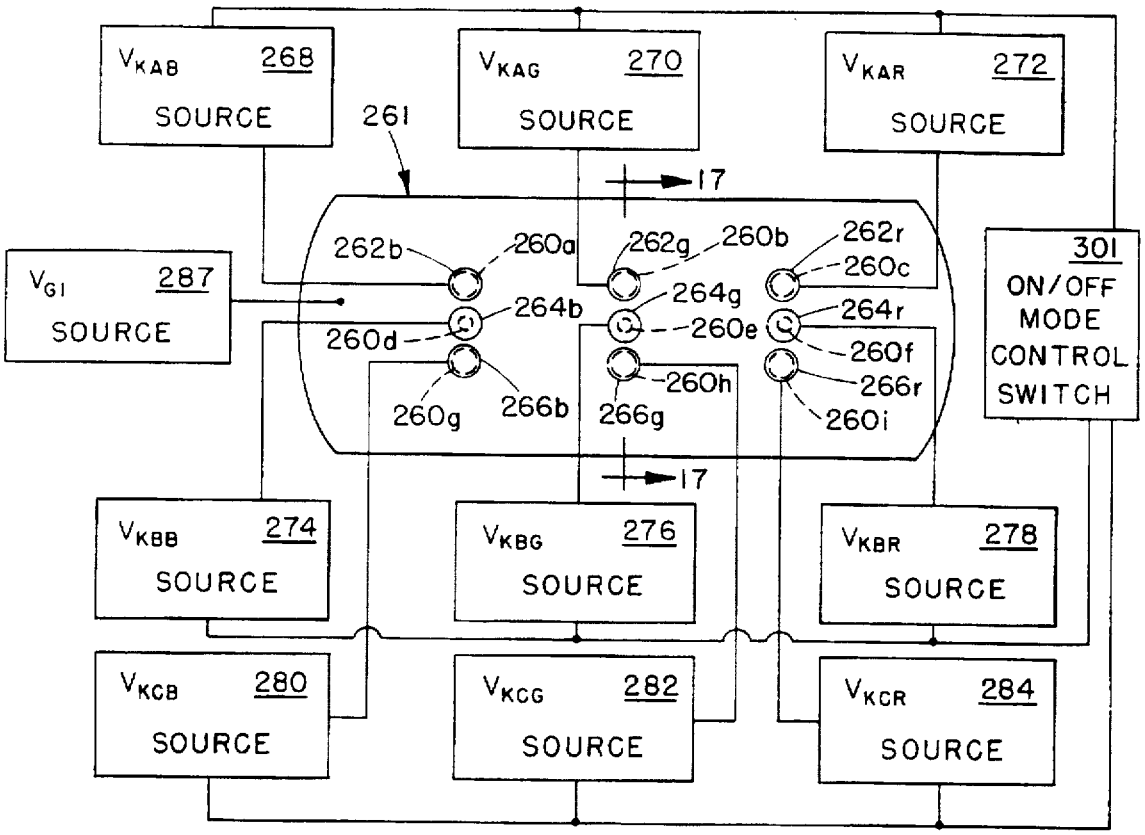
FIG. 16 is an aft elevation view of another embodiment of a plurality of cathodes and G1 control grid combination for use in the present invention showing each of the cathodes coupled to a respective video signal source as well as to a mode control switch.
Figure 17:
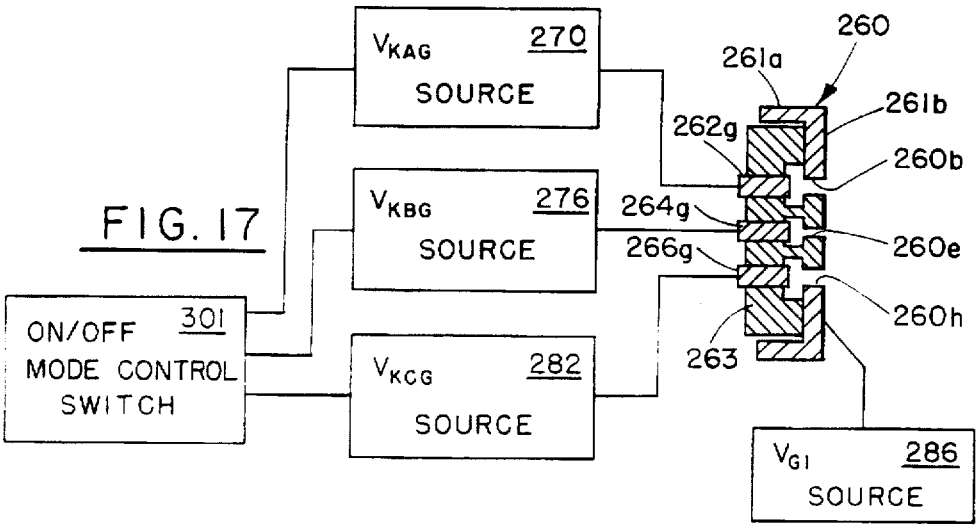
FIG. 17 is a lateral sectional view of the cathode and G1 control grid combination shown in FIG. 16 taken along site line 17—17 therein.

Referring to FIG. 16, there is shown an aft elevation view of another embodiment of a G1 control grid 261 for use in the present invention. A lateral sectional view of the G1 control grid 261 shown in FIG. 16 taken along site line 17—17 therein is shown in FIG. 17. The G1 control grid 261 includes a 3×3 matrix of apertures shown in dotted-line form including an upper row of apertures 260*a*, 260*b* and 260*c*; an intermediate row of apertures 260*d*, 260*e* and 260*f*; and a lower row of apertures 260*g*, 260*h* and 260*i*. As in the previously described embodiment, the upper row of apertures 260*a*, 260*b* and 260*c* and the lower row of apertures 260*g*, 260*h* and 260*i* are larger in diameter than the intermediate row of apertures 260d, 260e and 260f. The upper and lower rows of apertures provide electron beams having a large cross-section and greater peak current and are intended for use together in a television receiver mode of operation. The intermediate row of apertures provides electron beams which are smaller in diameter for use in a high resolution mode of operation such as in a graphic/character display. Disposed aft of and adjacent to each of the aforementioned apertures is a respective cathode. Thus, an upper row of cathodes 262b, 262g and 262r are respectively disposed aft of and adjacent to apertures 260a, 260b and 260c. Similarly, an intermediate row of cathodes 264b, 264g and 264r are respectively disposed immediately aft of apertures 260d, 260e and 260f. Finally, a lower row of cathodes 266b, 266g and 266r are respectively disposed immediately aft of apertures 260g, 260h and 260i. The G1 control grid 261 includes a generally flat end wall 261b containing the matrix of apertures and a side wall 261a extending about the periphery of the end wall. Disposed within the end wall 261b and including a plurality of spaced apertures for receiving and supporting each of the cathodes is an insulating ceramic substrate 263. The G1 control grid 261 is preferably comprised of a conductive metal and is biased by a $V_{G1}$ voltage source 286. Each of the cathodes when heated generates a respective plurality of energetic electrons which are directed through an adjacent aperture in the G1 control grid 261. In this manner, nine spaced electron beams arranged in a 3×3 matrix are formed by the G1 control grid 261 and are directed toward a G2 screen grid in the electron gun which is not shown in the figures for simplicity.

Each of the cathodes is coupled to and energized by a respective video signal source. Thus, each of the upper row cathodes 262b, 262g and 262r is respectively coupled to the $V_{KAB}$, $V_{KAG}$ and $V_{KAR}$ video signal sources 268, 270 and 272. Similarly, each of the intermediate row of cathodes 264b, 264g and 264r is respectively coupled to the $V_{KBB}$, $V_{KBG}$ and $V_{KBR}$ video signal sources 274, 276 and 278. Finally, each of the lower row cathodes 266b, 266g and 266r is respectively coupled to the $V_{KCB}$, $V_{KCG}$ and $V_{KCR}$ video signal sources 280, 282 and 284. Each of the video signal sources provides a modulating signal to its associated cathode for controlling the electrons emitted by the cathode and the resulting video image formed by the electron beam. Video memories (not shown) in the upper three video signal sources 268, 270 and 272 and in the lower three video signal sources 280, 282 and 284 allow the video signal sources associated with different horizontal scan lines to temporarily store video data, such as in a received television signal, for subsequent recall and simultaneous display with video data associated with adjacent horizontal scan lines as previously described. An ON/OFF mode control switch 301 is shown coupled to each of the aforementioned video signal sources for mining on the three upper and three lower electron beams and blocking the three intermediate electron beams when in the television receiver mode of operation or for turning on the three intermediate electron beams and blocking the three upper and three lower electron beams when in the high resolution graphics and/or character display mode of operation.

Figure 18:
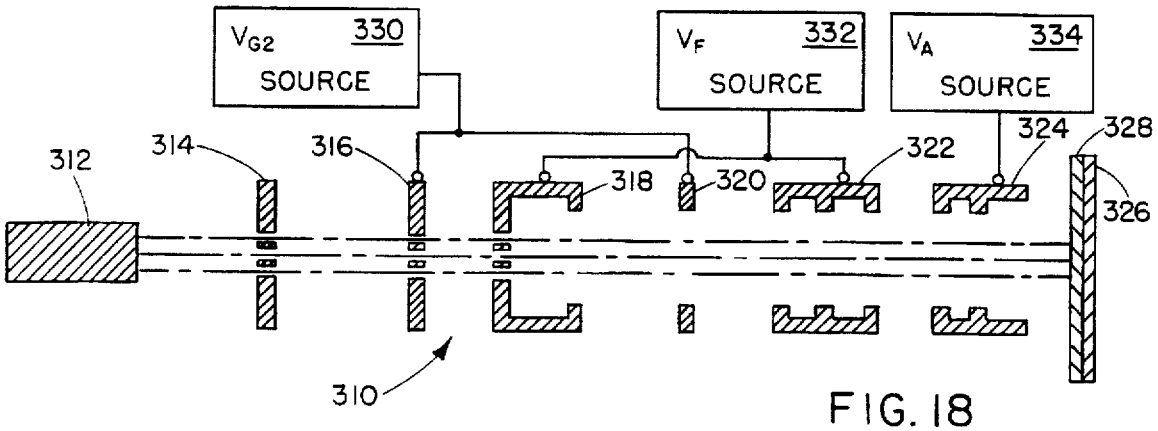
FIG. 18 is a generally vertical, longitudinal sectional view of yet another embodiment of an electron gun in accordance with the present invention.
Figure 19:
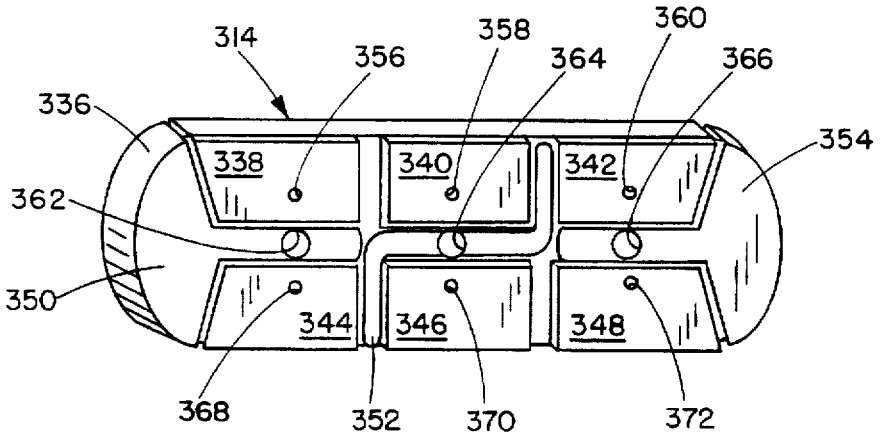
FIG. 19 is an elevation view of the G1 control grid of the electron gun shown in FIG. 18.

Referring to FIG. 18, there is shown a generally vertical, longitudinal sectional view of yet another embodiment of an electron gun 310 in accordance with the present invention. FIG. 19 is an elevation view of the G1 control grid 314 of the electron gun 310 shown in FIG. 18. Electron gun 310 includes three cathodes (only one of which is shown as element 312 in the figure), a G1 control grid 314, a G2 screen grid 316, and G3, G4, G5 and G6 grids 318, 320, 322 and 324. Electron gun 310 directs a 3×3 matrix of electron beams onto a faceplate 326 having an inner phosphor layer 328. The G2 screen and G4 grids 316, 320 are coupled to a $V_{G2}$ voltage source 330, while the G3 and G5 grids 318, 322 are coupled to a $V_F$ (focus) voltage source 332. The G6 grid is coupled to a $V_A$ (accelerating) voltage source 334.

The electron gun's G1 control grid 314 includes three upper conductive portions 338, 340 and 342; three middle, or intermediate, conductive portions 350, 352 and 354; and three lower conductive portions 344, 346 and 348. All of the aforementioned conductive portions are disposed on a surface of a nonconductive substrate 336 and each has a respective beam passing aperture passing therethrough. Thus, upper beam passing apertures 356, 358 and 360 are respectively disposed in upper conductive portions 338, 340 and 342. Similarly, intermediate beam passing apertures 362, 364 and 366 are disposed in intermediate conductive portions 350, 352 and 354, while lower beam passing apertures 368, 370 and 372 are disposed in lower conductive portions 344, 346 and 348, respectively. The three intermediate beam passing apertures 362, 364 and 366 are larger in diameter than the three upper and three lower beam passing apertures. The three horizontally aligned, intermediate electron beams are therefore larger in cross section and have a greater peak current than the three upper and three lower electron beams. The three intermediate electron beams are therefore employed in a television receiver mode of operation, while the three upper and three lower electron beams are used in combination in a high resolution video monitor mode of operation.

As shown in FIG. 18, the upper electron beams are directed on a first, upper scan line on display screen 326, while the lower electron beams are directed on a second lower scan line. Simultaneous scanning of more than one video image horizontal trace line permits the electron beam scan frequency to be reduced to one half with a corresponding reduction in deflection yoke cost and deflection power. Again, the video signal drivers coupled to the upper and lower conductive portions of the G1 control grid 314 include a line video memory to convert the real time input video signal to a delayed video signal as previously described.

Figure 20:
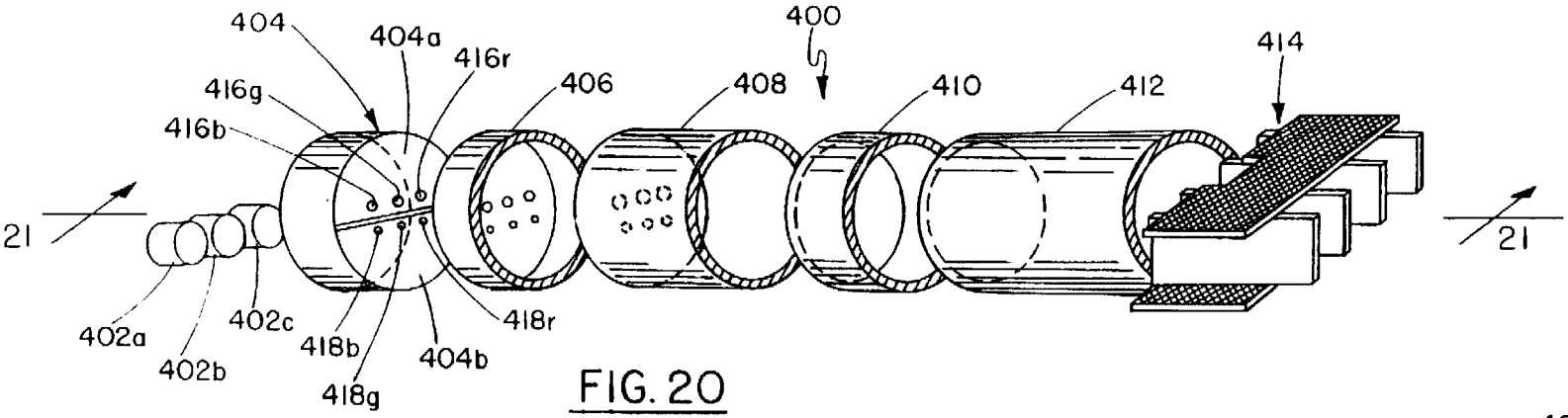
FIG. 20 is a perspective view of a multi-beam, common lens-type electron gun in accordance with another embodiment of the present invention for use in a multi-mode, hybrid-type color CRT.
Figure 21:
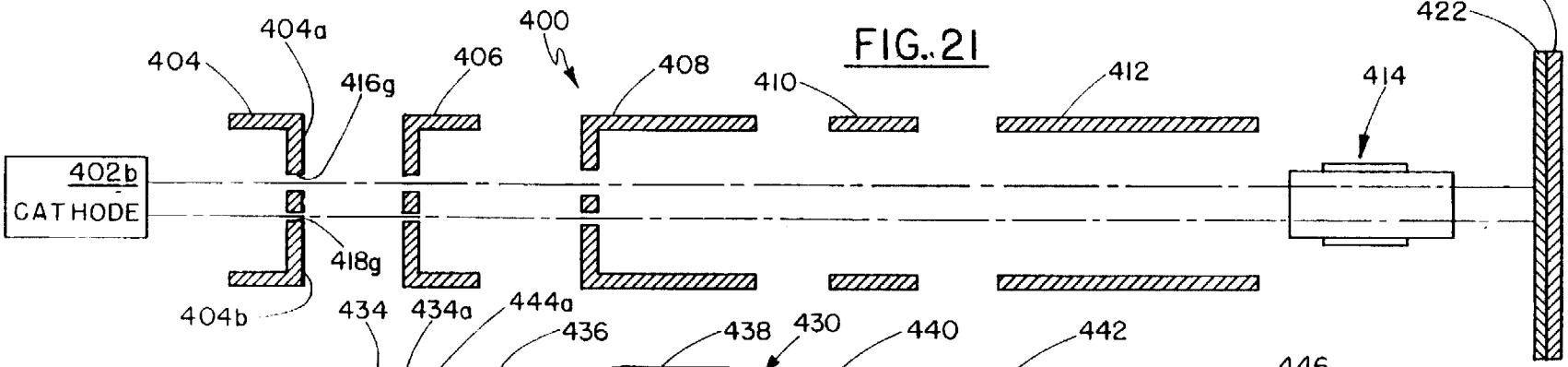
FIG. 21 is a longitudinal sectional view of the multi-beam, common lens-type electron gun of FIG. 20 taken along site 21—21 therein.

Referring to FIG. 20, there is shown a perspective view of yet another embodiment of an electron gun 400 for use in a multi-mode, hybrid-type color CRT. A longitudinal sectional view of the electron gun 400 shown in FIG. 20 taken along site line 21—21 therein is illustrated in FIG. 21. Electron gun 400 includes three inline cathodes 402a, 402b and 402c each providing energetic electrons in producing an electron beam for providing one of the three primary colors of red, green and blue. Electron gun 400 further includes a G1 control grid 404, a G2 screen grid 406, a G3 grid 408, a G4 grid 410, and a G5 grid 412. Disposed between the electron gun's G5 grid 412 and the CRT's display screen (not shown in the figures for simplicity) is a beam convergence deflector 414, which electrostatically converges the electron beams and deflects the beams in a raster-like manner over the CRT's display screen. Details of the structure and operation of the beam convergent deflector 414 are disclosed in co-pending application Ser. No. 07/098,072, now U.S. Pat No. 5,352,883, filed Jul. 28, 1993, and assigned to the assignee of the present application, entitled "Multi-Beam Electron Gun with Common Lens for Color CRT."

The G1 control grid 404 includes an upper conductive portion 404a and a lower conductive portion 404b in facing relation to the G2 screen grid 406. Also, disposed in the G1 control grid 404 in facing relation with the G2 screen grid 406, are three upper apertures 416b, 416g and 416r and three lower apertures 418b, 418g and 418r. The three upper apertures are disposed in the upper conductive portion 404a, while the three lower apertures are disposed in the lower conductive portion 404b. The three upper apertures are in horizontal alignment as are the three lower apertures. Each of the aforementioned apertures in the G1 control grid 404 passes energetic electrons emitted by a respective one of the cathodes in directing a plurality of electron beams toward the CRT's display screen. Each of the G2 and G3 grids, 406 and 408 also includes three upper horizontally aligned and three lower horizontally aligned beam passing apertures, each aligned with a respective beam passing aperture in the G1 control grid 404. As in some of the previously described embodiments, the upper and lower conductive portions 404a and 404b of the G1 control grid 404 are each coupled to an ON/OFF mode control switch and the three cathodes are each coupled to a respective video signal source (although these elements are not shown in the figures for simplicity) to permit a user to switch between the upper three beam passing apertures and the lower three beam passing apertures in the G1 control grid.

As shown in the figures and in accordance with the invention, the three upper beam passing apertures are larger in diameter than the three lower beam passing apertures in the G1, G2 and G3 grids 404, 406 and 408. Thus, the three upper electron beams have a larger diameter and a larger peak current for increased video image brightness and are particularly adapted for use when the CRT is used as a television receiver. The lower apertures provide three horizontally aligned electron beams smaller in diameter so as to produce a reduced beam spot size on the CRT's display screen for high video image resolution such as when the CRT is used as a monitor for graphics and/or character display. The aforementioned mode switch allows a user to switch between the television receiver mode of operation, wherein the three electron beams directed unto the CRT's display screen pass through the upper, larger trios of beam passing apertures in the G1, G2 and G3 grids, and a high resolution monitor mode of operation where the three electron beams incident on the CRT's display screen pass through the smaller, lower electron beam passing apertures in these grids.

Figure 22:
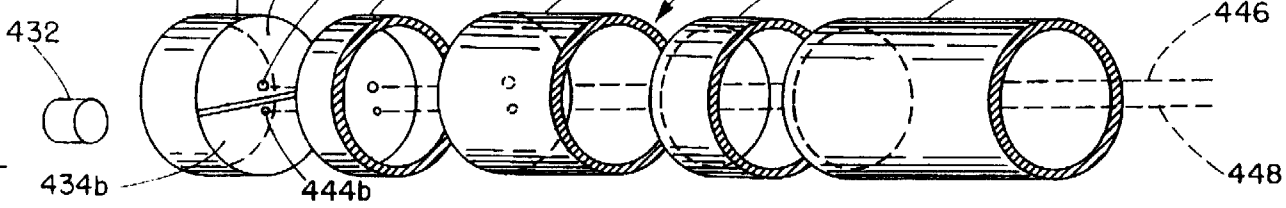
FIG. 22 is a perspective view of an electron gun in accordance with another embodiment of the present invention for use in multi-mode, hybrid-type monochrome CRT.

Referring to FIG. 22, there is shown a perspective view of an electron gun 430 with yet another embodiment of the present invention for use in a monochrome CRT. Electron gun 430 is of the common lens type and includes a cathode 432, a G1 control grid 434, a G2 screen grid 436, a G3 grid 438, a G4 grid 440, and a G5 grid 442. A video signal source (not shown) is coupled to cathode 432 for providing video information thereto. The G1 control grid 434 includes upper and lower conductive portions 434a and 434b in facing relation to the G2 screen grid 436. Disposed in the upper conductive portion 434a is an upper beam passing aperture 444a, while disposed in a lower conductive portion 434b is a lower beam passing aperture 434b. Similar vertically aligned apertures each aligned with either the upper or lower beam passing apertures 444a and 444b in the G1 control grid 434 can also be found in the G2 screen grid 436 and in the G3 grid 438. The upper aligned beam passing apertures in the G1 control, G2 screen and G3 grids 434, 436 and 438 are each larger in diameter than the corresponding lower beam passing apertures in these grids. Thus, an upper electron beam 446 (shown in dotted line form) is larger in diameter and in peak beam current than a lower electron beam 448 (also shown in dotted line form) generated by the electron gun 430 and directed onto the display screen 420 of a CRT in which the electron gun is employed. Disposed on the display screen's inner surface is a phosphor layer 422. A user operated ON/OFF mode control switch (also not shown) is coupled to the G1 control grid's upper and lower conductive portions 434a and 434b, as shown and described in the embodiments discussed above, allowing a user to select between the upper, larger electron beam 446 when in a television receiver mode of operation or the lower, smaller electron beam 448 when in a high resolution display mode of operation such as for a graphics and/or character display monitor.

Figure 23:
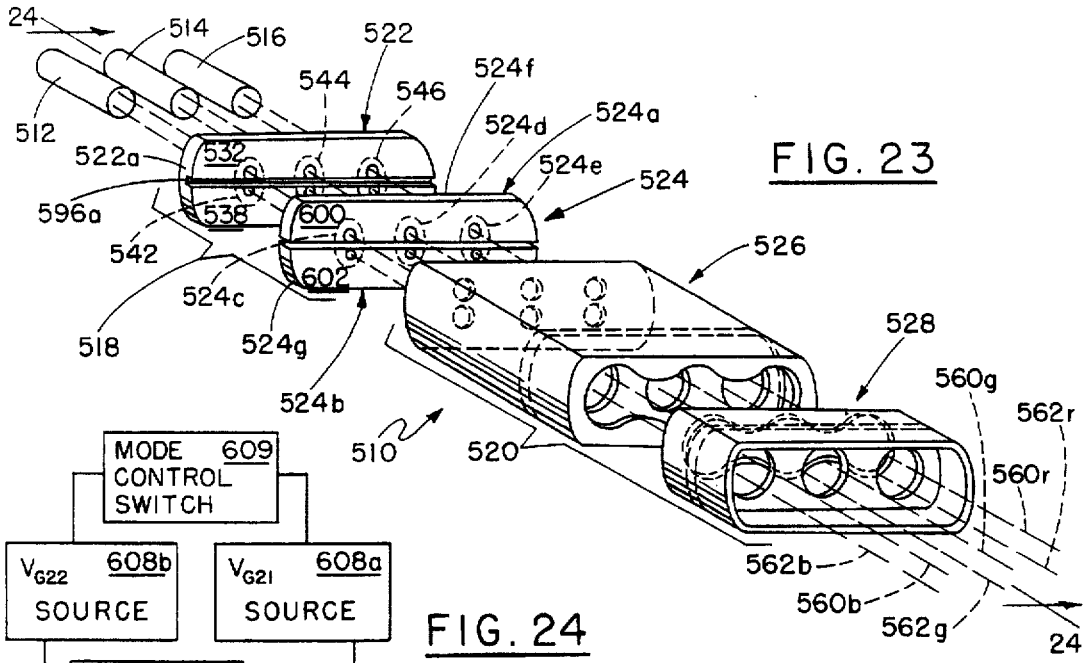
FIG. 23 is simplified isometric view shown partially in phantom of another embodiment of an electron gun for use in a multi-mode, hybrid-type color CRT in accordance with the present invention.
Figure 24:
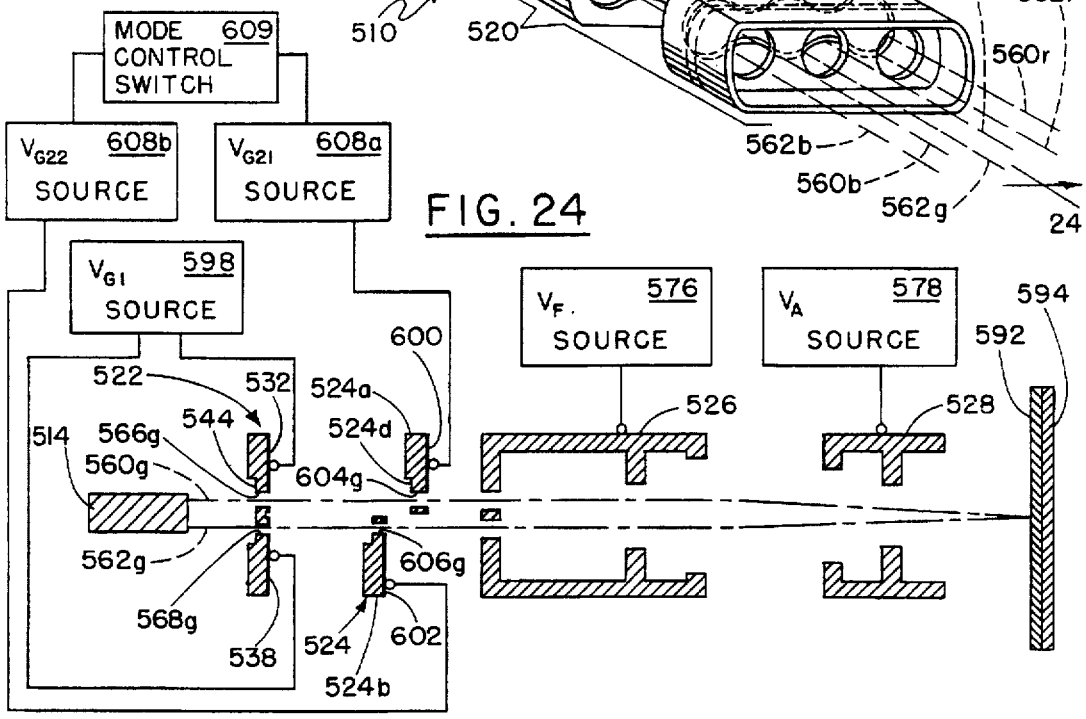
FIG. 24 is a generally vertical, longitudinal sectional view of the inventive electron gun shown in FIG. 23 taken along site line 24—24 therein.

Referring to FIG. 23, there is shown a simplified isometric view partially in phantom of an electron gun 510 for a color CRT in accordance with yet another embodiment of the present invention. FIG. 24 is a longitudinal vertical sectional view of the electron gun 510 shown in FIG. 23 taken along site line 24—24 therein showing different G1–G2 grid spacing between the first and second operating mode electron guns. Electron gun 510 is of the bi-potential type and includes a plurality of in-line cathodes 512, 514 and 516 for providing energetic electrons in the direction of a G1 control grid 522. The G1 control grid 522 in combination with a G2 screen grid 524 provides a beam forming region (BFR) 518 in electron gun 510 for forming the energetic electrons into three pairs of vertically aligned electron beams 560b, 562b; 560g, 562g; and 560r, 562r. Additional details of the G2 screen grid 524 are shown in the elevation view of FIG. 25 and are described in detail below. The center pair of electron beams are shown in dotted line form in the sectional view of FIG. 24 as upper electron beam 560g and lower electron beam 562g.

The G1 control grid 522 is in the general form of a flat plate having three pairs of vertically aligned apertures for passing the six electron beams. The G1 control grid 522 is comprised of a non-conductive ceramic substrate 522a having first, second and third coined or recessed portions 542, 544 and 546 (shown in dotted line form) in facing relation to the three cathodes 512, 514 and 516. Disposed within the first coined portion 542 and extending through the ceramic substrate 522a are a pair of vertically aligned apertures. Similarly, respectively disposed within the second and third coined portions 544 and 546 and extending through the ceramic substrate 522a are second and third pairs of vertically aligned apertures.

The G2 screen grid 524 is in the form of an upper G2 screen grid 524a and a lower G2 screen grid 524b. Each of the upper and lower G2 screen grids 524a, 524b includes a respective non-conductive ceramic substrate 524f and 524g. Respective pairs of aligned apertures in the G1 control grid 522 and the separate upper and lower G2 screen grids 524a, 524b pass vertically aligned pairs of electron beams 560b, 562b; 560g, 562g; and 560r, 560r. As viewed in FIG. 23, the aligned apertures in the G1 control grid 522 and upper and lower G2 screen grids 524a, 524b on the left and right-hand sides respectively pass a pair of blue electron beams and a pair of red electron beams, while the center pairs of vertically aligned apertures in these two grids pass a pair of green electron beams. The trio of upper apertures in each of the G1 control grid 522 and the upper G2 screen grid 524a are larger in diameter than the trio of lower apertures in the G1 control grid and the lower G2 screen grid 524b. The three upper electron beams are thus larger in cross-section than the three lower electron beams. Thus, the trio of upper apertures in the G1 control grid 522 and the upper G2 screen grid 524a pass three electron beams for generating the primary colors for a low resolution display such as in a conventional television receiver, while the lower trios of apertures similarly pass three electron beams which generate the primary colors for a high resolution display such as in graphics and alphanumeric character displays. The three electron beams transmitting the upper sets of aligned apertures are converged and focused on a spot on the display screen, as are the electron beams transmitting the aligned array of lower apertures.

The G1 control grid 522 includes upper and lower conductive portions 532 and 538 to which is connected a $V_{G1}$ source 598 for charging the G1 control grid. Similarly, the upper and lower G2 screen grids 524a and 524b include respective upper and lower conductive portions 600 and 602. Each of the aforementioned conductive portions are formed on the grid's ceramic substrate by affixing a thin conductive metallic layer to the surface of the ceramic substrate such as by brazing or cramping. Each of the aforementioned conductive portions 600 and 602 on each of the upper and lower G2 screen grids 524a and 524b encloses a respective trio of beam passing apertures. The three larger beam passing apertures in the upper G2 screen grid 524a are respectively disposed in coined or recessed portions 524e, 524d and 524e shown in dotted line form. The three smaller beam passing apertures in the lower G2 screen grid 524b are also each disposed in a respective recessed portion. The recessed portions in the upper and lower G2 screen grids 524a, 524b are in facing relation to the G1 control grid 522.

The three cathodes 512, 514 and 516 in combination with the three larger horizontally aligned upper apertures in the G1 control and upper G2 screen grid screen grids 522, 524a are capable of emitting three electron beams each having a peak current on the order of 4–5 ma for use when the CRT incorporating electron gun 510 is used as a television receiver. The three cathodes 512, 514 and 516 in combination with the three smaller horizontally aligned lower beam passing apertures in the G1 control and lower G2 screen grids 522, 524b are designed to direct three electron beams toward the CRT display screen, each having a peak current on the order of 400–500 μA for use when the electron gun is used in a high resolution video monitor mode of operation such as in a computer terminal. The three upper electron beams having a larger cross-section and peak current provide a video image of sufficient brightness for use in a conventional television receiver. The reduced cross-section of each of the three lower electron beams passing through the aligned trios of lower apertures and the G1 control and lower G2 screen grids 522, 524b with their reduced current provide a video image having high resolution for use in a CRT employed as a graphics and/or character display device.

As in the previously described embodiments, each of the three cathodes 512, 514 and 516 is coupled to and driven by a respective video signal source, although this is not shown in the figures for simplicity. The aforementioned video signal sources apply appropriate video signals to each of the three cathodes for controlling the various electron beams in presenting a video image on the display screen. When the electron gun 510 is used in a television receiver mode of operation, a $V_{G21}$ source 608a provides an appropriate voltage to the conductive portion 600 of the upper G2 screen grid 524a for permitting electron beams to transit the trio of beam passing apertures in this grid. At the same time, a $V_{G22}$ source 608b provides an appropriate voltage to the conductive portion 602 of the lower G2 screen grid 524b to prevent transit of the three lower electron beams through the electron gun's beam forming region 518. In a graphics and/or character display mode of operation, the $V_{G22}$ source 608b provides an appropriate voltage to the conductive portion 602 of the lower G2 screen grid 524b to permit transit of electron beams through the trio of lower beam passing apertures in the lower G2 screen grid. Also in this mode of operation, the $V_{G21}$ source provides an appropriate voltage to the conductive portion 600 of the upper G2 screen grid 524a to prevent transit of the three upper electron beams through the beam forming region 518. In this manner, the user operated $V_{G21}$ and $V_{G22}$ voltage sources coupled to and controlled by a user responsive mode control switch 609 allow for selecting between the larger electron beam cross-section television receiver mode of operation and the smaller electron beam cross-section high resolution graphics and/or character display mode of operation.

Figure 25:
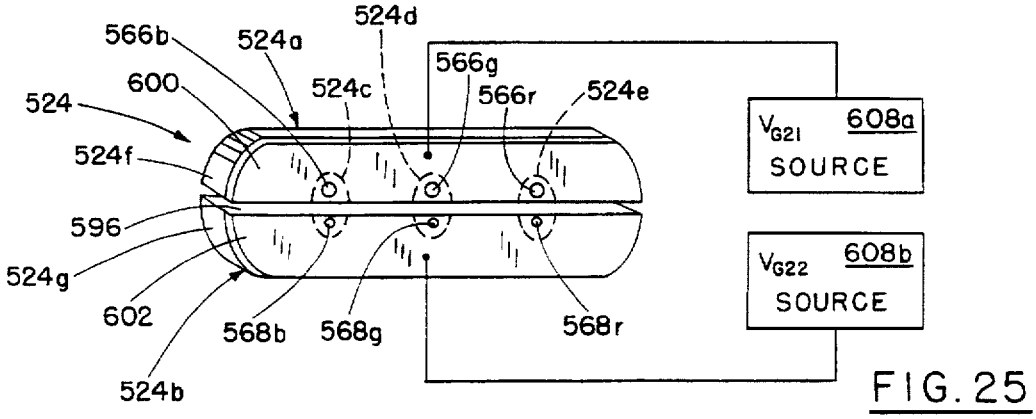
FIG. 25 is an elevation view of the G2 control grid of the electron gun shown in FIG. 23 illustrating in simplified block diagram form video signal sources and a mode control switch coupled to the G2 screen grid in accordance with one embodiment of the present invention.

FIG. 24 in its representation of the upper and lower G2 screen grids 524a and 524b has been modified from the configuration of these two grids shown in FIGS. 23 and 25 for the purpose of illustrating another feature of the present invention. In FIG. 24, the spacing between the upper G2 screen grid 524a and the G1 control grid 522 is greater than the spacing between the lower G2 screen grid 524b and the G1 control grid. By separating the G2 screen grid 524 into an upper G2 screen grid 524a for use in a first television receiver mode of operation and a lower G2 screen grid 524b for use in a high resolution video monitor mode of operation, the G1–G2 grid spacing may be different for the two modes of operation in providing additional flexibility in electron gun design and performance. In general, the spacing between the G1 control grid 522 and the upper G2 screen grid 524a in the television receiver mode of operation will be greater than the spacing between the G1 control grid and the lower G2 screen grid 524b in the high resolution video monitor mode of operation.

Electron gun 510 further includes the combination of a G3 grid 526 and a G4 grid 528 which, in combination, form a high voltage focusing lens 520 for focusing the electron beams on and accelerating the electrons toward a display screen 594 having a phosphor coating 592 on its inner surface. The G3 grid 526 is coupled to a focus voltage ($V_F$) source 576 for focusing the electron beams on the display screen 594, and the G4 grid 528 is coupled to an accelerating voltage ($V_A$) source 578 for accelerating the electrons toward the display screen 594. Details of the configuration and operation of the high voltage focusing lens 520 and its G3, G4 grids 526, 528 are as previously described for the bi-potential electron gun shown in FIGS. 1 and 2.

Various advantages are realized in providing the electron gun 510 for use in a multi-mode, hybrid-type CRT with an upper G2 screen grid 524a and a lower G2 screen grid 524b. For example, electron beams used in a conventional television receiver mode of operation and the beams used in the high resolution video monitor mode of operation have different cutoff voltages. The higher beam currents used in the television receiver mode of operation require a higher cutoff voltage. The present invention allows for increasing the beam cutoff voltage of the upper three electron beams by changing the spacing between the upper G2 screen grid 524a and the G1 control grid 522 without changing the position of the lower G2 screen grid 524b and affecting the cutoff voltage of the three lower electron beams. This permits independent adjustment of the cutoff voltage for the beams used in the two modes of operation. This minimizes the impact on beam cutoff voltage of the restrictions in the size of the CRT's glass envelope which limited prior approaches in their attempt to provide different electron beam operating parameters for different video display applications. Independent positioning of the upper 132 and lower G2 screen grids 524a and 524b not only allows more flexibility in CRT design, but also permits these two charged grids to function in combination with the G1 control grid 522 in establishing the electron beam cutoff voltage which permits higher electron beam currents and improved video image brightness. The application of different control voltages to the upper G2 and lower G2 screen grids 524a, 524b also allows for improved control over electron beam cutoff voltage. The present invention thus provides for increased electron beam current and improved control over electron beam cutoff voltage without increasing the size of the CRT envelope.

Figure 26:
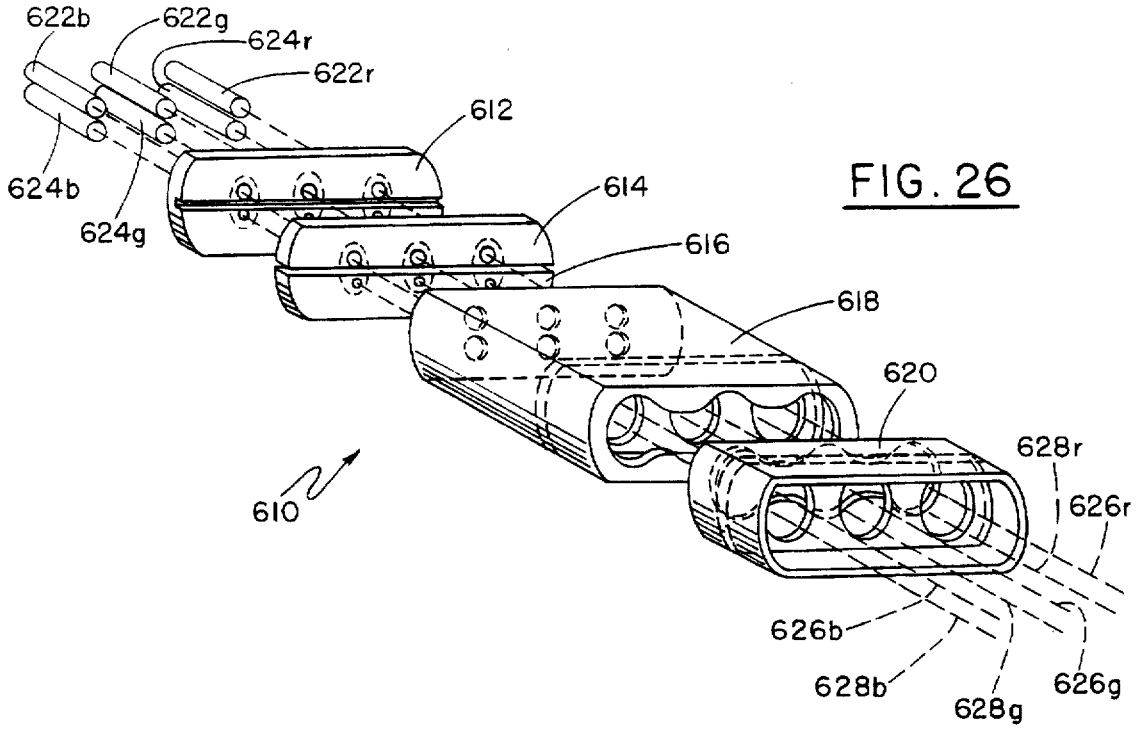
FIG. 26 is a simplified isometric view shown partially in phantom of yet another embodiment of an electron gun for use in a multi-mode, hybrid-type CRT in accordance with the present invention.

Referring to FIG. 26, there is shown yet another embodiment of an electron gun 610 for use in a multi-mode, hybrid-type CRT in accordance with the present invention. As in the previously described embodiment illustrated in FIG. 23, electron gun 610 includes a G1 control grid 612, upper and lower G2 screen grids 614 and 616, a G3 grid 618, and a G4 grid 620. In the embodiment shown in FIG. 26, the three upper electron beams 626b, 626g and 626r are respectively generated by three inline upper cathodes 622b, 622g and 622r. Similarly, the three lower inline electron beams 628b, 628g and 628r are respectively generated by three inline lower cathodes 624b, 624g and 624r. The three upper inline cathodes 622b, 622g and 622r are respectively aligned with the larger inline beam passing apertures in the G1 control grid 612 and the upper G2 screen grid 614. Similarly, the three lower inline cathodes 624b, 624g and 624r are aligned with respective smaller electron beam passing apertures in the G1 control grid 612 and the lower G2 screen grid 616. Respective blue video signal sources are coupled to cathodes 622b and 624b, while respective green video signal sources are coupled to cathodes 622g and 624g. Finally, respective red video signal sources are coupled to cathodes 622r and 624r. The aforementioned video signal sources are omitted from FIG. 26 for simplicity, although a similar arrangement is described above and is illustrated in FIGS. 16 and 17. Thus, a first trio of color video signal sources are coupled to cathodes 622b, 622g and 622r for providing color video signal information when operating in the television receiver mode of operation. A second trio of color video signal sources are coupled to cathodes 624b, 624g and 624r for providing a color video image in the high video image resolution mode of operation.

The embodiments of the invention shown in FIGS. 23–26 have the advantage that when using the CRT incorporating the inventive electron gun in a television receiver mode of operation employing the larger diameter electron beams having larger beam currents, a higher beam cutoff may be established by controlling individual electron beam operation using both the G1 control and G2 screen grids. For example, a beam cutoff on the order of 150V could be employed by controlling both the G1 control and G2 screen grids to permit increased beam currents and a brighter video image in the television receiver mode of operation. In the high resolution display mode of operation, a lower beam cutoff voltage, e.g., on the order of 100V, may be employed because of the lower beam currents in this mode of operation. Independent adjustment of the spacing between the G1 control grid and upper and lower G2 screen grids in the two modes of operation also provides increased flexibility in establishing electron beam performance characteristics for the various modes of operation. Exercising individual control over each electron beam using the G1 control grid as well as the G2 screen grid allows the CRT designer more flexibility in terms of selecting grid operating voltages and setting the G1–G2 inter-grid spacing for the separate modes of operation.

There has thus been shown a multi-mode, hybrid-type CRT and electron gun therefor for operating in two or more modes for use as either a television receiver display or as a high resolution video monitor. In a monochrome embodiment, the electron gun directs a single, narrow electron beam onto the display screen when the CRT is used as a monitor, or directs a larger diameter electron beam onto the display screen when used as a television receiver. The two modes of operation, as well as the electron beam used in each, are selectable by the viewer. In a color CRT embodiment, the electron gun directs a plurality of electron beams onto the CRT's display screen, with the electron beams arranged in two or more groups. In one group of electron beams, the beam forming portion of the electron gun, i.e., its G1 screen and G2 control grids, provides small diameter electron beams having reduced spot size on the CRT's display screen for high video image resolution when used as a monitor for graphics and/or character display. In another group of electron beams, the beam forming portion of the electron gun provides electron beams having a larger diameter and peak current for increased video image brightness when used as a television receiver. Each group of electron beams includes a plurality of horizontally aligned electron beams, with each beam within a group providing one of the primary colors of red, green or blue. The G2 control grid is divided into an upper G2 control grid for use in the television receiver mode of operation and a lower G2 control grid for use in the high resolution mode of operation. The G2 upper and lower control grids are coupled to separate voltage sources to permit independent adjustment of the beam cutoff voltages for the electron beams used in the two modes of operation. The spacing between the GI screen grid and the upper and lower G2 control grids can also be selected to provide the larger diameter beams in the television mode of operation and the smaller diameter beams in the high resolution mode of operation with the desired characteristics for the two modes of operation. By independently establishing the G1–G2 grid spacing and beam cutoff voltages for the two modes of operation, flexibility in electron gun performance and design is afforded.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An electron gun for use in a multi-mode cathode ray tube (CRT) including a display screen whereon a video image is formed by sweeping an electron beam over a plurality of vertically spaced, horizontal scan lines in a raster-like manner, said electron gun comprising:

cathode means for providing energetic electrons;

a beam forming region (BFR) including first and second spaced, charged grids disposed adjacent said cathode means and further including:

first beam forming means for forming said energetic electrons into a first electron beam having a cross-section $A_1$ when the CRT is used as a television receiver; and second beam forming means for forming said energetic electrons into a second electron beam having a cross-section $A_2$ when the CRT is used as a high resolution video monitor, where $A_1>A_2$;

said BFR further including a G1 control grid and first and second G2 screen grids, wherein said first and second G2 screen grids are separate and detached from one another and respectively include a first beam passing aperture having a diameter $D_1$ for passing said first electron beam and a second beam passing aperture having a diameter $D_2$ for passing said electron beam, where $D_1>D_2$;

switch means coupled to said first and second G2 screen grids for allowing a user to select either said first electron beam in a television receiver mode of operation or said second electron beam in a high resolution video monitor mode of operation; and lens means disposed intermediate said BFR and the CRT's display screen for focusing either said first electron beam or said second electron beam on the display screen.

2. The electron gun of claim 1 wherein said G1 control grid includes first and second conductive portions respectively aligned with said first and second G2 screen grids and respectively defining first and second beam passing apertures in said G1 control grid, and wherein said G1 control grid further includes a non-conductive insulating portion disposed intermediate said first and second conductive portions.

3. The electron gun of claim 2 wherein said first and second conductive portions of said G1 control grid are in facing relation to said first and second G2 screen grids.

4. The electron gun of claim 2 wherein the first beam passing apertures in said G1 control grid and said first G2 screen grid respectively have diameters on the order of 0.5 mm–0.8 mm and 0.5 mm–1.0 mm, and wherein the second beam passing apertures in said G1 control grid and said second G2 screen grid respectively have diameters on the order of 0.3 mm–0.5 mm and 0.3 mm–0.7 mm.

5. The electron gun of claim 4 wherein said first electron beam has a peak current on the order of 4 mA–5 mA and said second electron beam has a peak current on the order of 400 μA–500 μA.

6. The electron gun of claim 5 wherein said first and second beam passing apertures in said G1 control grid and said first and second beam passing apertures in the first and second G2 screen grids are in generally vertical alignment.

7. The electron gun of claim 1 wherein said lens means includes third and fourth charged grids respectively including aligned apertures for passing and focusing the electron beams on the display screen.

8. The electron gun of claim 7 wherein said third grid further includes first and second vertically aligned apertures for respectively passing said first and second electron beams, and wherein said first and second vertically aligned apertures are in facing relation to said first and second G2 screen grids.

9. The electron gun of claim 1 wherein said electron gun is a bi-potential or quadrupole type of electron gun.

10. The electron gun of claim 1 wherein said G1 control grid includes three pairs of vertically aligned, horizontally spaced apertures, with each pair including a first aperture having a diameter $D_3$, and a second aperture having a diameter $D_4$, and wherein said first G2 screen grid includes three horizontally spaced first apertures having said diameter $D_1$, and said second G2 screen grid includes three horizontally spaced second apertures having said diameter $D_2$.

11. The electron gun of claim 10 wherein said cathode means includes a first three horizontally aligned cathodes each aligned with a respective one of said first apertures of said G1 control grid and of said first G2 screen grid and a second three horizontally aligned cathodes each aligned with a respective one of said second apertures of said G1 control grid and of said second G2 screen grid.

12. The electron gun of claim 1 wherein said cathode means includes a first cathode aligned with the first apertures of said G1 control and a second said first G2 screen grid and a second cathode aligned with the second apertures of said G1 control grid and said second G2 screen grid.

13. An electron gun for a multi-mode color cathode ray tube (CRT) including a display screen whereon a video image is formed by sweeping a plurality of horizontally aligned electron beams over a plurality of vertically spaced, horizontal scan lines in a raster-like manner, wherein each electron beam provides one of the three primary colors of red, green or blue of the video image, said electron gun comprising:

cathode means for providing energetic electrons;

a beam forming region (BFR) disposed adjacent to said cathode means and including:

first beam forming means for forming said energetic electrons into a first plurality of horizontally aligned, spaced electron beams providing the three primary colors of red, green and blue, wherein each of said first plurality of electron beams has a cross-section $A_1$ when the CRT is used as a television receiver; and second beam forming means for forming said energetic electrons into a second plurality of horizontally aligned, spaced electron beams providing the three primary colors of red, green and blue, wherein each of said second plurality of electron beams has a cross-section $A_2$ when the CRT is used as a high resolution video monitor, where $A_1>A_2$;

said BFR further including a G1 control grid and first and second G2 screen grids, wherein said first and second G2 screen grids are separate and detached from one another and respectively include first upper and second lower pluralities of horizontally aligned beam passing apertures, wherein each of said first pluralities of upper apertures has a diameter $D_1$ and each of said second pluralities of lower apertures has a diameter of $D_2$, and wherein said first pluralities of upper apertures forms said first electron beams and said second pluralities of lower apertures forms said second electron beams, with $D_1>D_2$, and wherein each first upper aperture is in vertical alignment with a respective second lower aperture;

switch means coupled to said first and second G2 screen grids for allowing a user to select either said fast electron beams in a television receiver mode of operation or said second electron beams in a high resolution video monitor mode of operation;

lens means disposed intermediate said BFR and the CRT's display screen for focusing the electron beams on the display screen; and convergence means disposed intermediate said lens means and the display screen for converging said first and second pluralities of horizontally aligned, spaced electron beams into first and second spots on the display screen.

14. The electron gun of claim 13 wherein said G1 control grid includes fast and second conductive portions disposed on said G1 control grid in facing relation to said fast and second G2 screen grids, and wherein said G1 control grid further includes a non-conductive insulating portion disposed intermediate said first and second conductive portions.

15. The electron gun of claim 14 wherein said G1 control grid includes first upper and second lower pluralities of beam passing apertures respectively aligned with the first upper and second lower pluralities of horizontally aligned beam passing apertures in said first and second G2 screen grids.

16. The electron gun of claim 15 wherein each of said first and second G2 screen grids includes a respective conductive portion disposed about the beam passing apertures therein.

17. The electron gun of claim 16 wherein said first plurality of apertures each has a diameter on the order of 0.5 mm–0.8 mm in said $G_1$ control grid and 0.5 mm–1.0 mm in said fast $G_2$ screen grid, and wherein said second plurality of apertures each has a diameter on the order of 0.3 mm–0.5 mm in said $G_1$ control grid and 0.3 mm–0.7 mm in said second $G_2$ screen grid.

18. The electron gun of claim 17 wherein each of said first plurality of electron beams has a peak current on the order of 4 mA–5 mA and said second pluralities of electron beams each has a peak current on the order of 400 μA–500 μA.

19. The electron gun of claim 18 wherein said first and second pluralities of apertures in said $G_1$ control grid and in said first and second $G_2$ screen grids are in generally vertical alignment.

20. The electron gun of claim 13 wherein said lens means includes third and fourth charged grids respectively including aligned apertures for passing and focusing the electron beams on the display screen.

21. The electron gun of claim 20 wherein said third grid further includes fast and second horizontally aligned groups of apertures for respectively passing said first and second pluralities of beams, and wherein each of said first plurality of apertures is in vertical alignment with a respective one of said second plurality of apertures, and wherein said fast and second pluralities of apertures in said third grid are in facing relation to said first and second $G_2$ screen grids.

22. The electron gun of claim 13 wherein said electron gun is a bi-potential or quadrupole type of electron gun.

* * * * *

UNITED STATES PATENT AND TRADEMARK OFFICE

CERTIFICATE OF CORRECTION

PATENT NO. : 5,689,158

DATED : Nov. 18, 1997

INVENTOR(S) : HSING-YAO CHEN

It is certified that error appears in the above-indentified patent and that said Letters Patent is hereby corrected as shown below:

| COLUMN | LINE | |
|---|---|---|
| 1 | 9 | "my" should be -- ray --. |
| 1 | 21 | "roster-like" should be -- raster-like --. |
| 1 | 44 | "prior an" should be -- prior art --. |
| 3 | 36 | "themthrough" should be -- therethrough --. |
| 5 | 47 | "colon" should be -- colors --. |
| 8 | 64 | "135" should be -- G5 --. |
| 11 | 39 | After "signal" **should be --source--** |
| 12 | 36 | "Faster-like" should be -- raster-like --. |
| 13 | 53 | "mining" should be -- turning --. |
| 17 | 19 | "524e" should be -- 524c --. |
| 18 | 64 | "132" should be --- G2 --. |
| 22 | 6 | Line should read -- of said G1 control grid and of said first G2 screen grid and --. |
| 22 | 49 | "fast" should be -- first --. |
| 22 | 62 | "fast" should be -- first --. |
| 22 | 63 | "fast" should be -- first --. |
| 23 | 13 | "fast" should be -- first --. |
| 24 | 10 | "fast" should be -- first --. |
| 24 | 14 | "fast" should be -- first --. |

Signed and Sealed this

Twenty-first Day of April, 1998

Bruce Lehman

*Attest:*

BRUCE LEHMAN

*Attesting Officer*

*Commissioner of Patents and Trademarks*